US010363200B2

(12) United States Patent
Omura et al.

(10) Patent No.: US 10,363,200 B2
(45) Date of Patent: Jul. 30, 2019

(54) TABLET SPLITTING APPARATUS

(71) Applicant: TOSHO, INC., Tokyo (JP)

(72) Inventors: Yoshihito Omura, Tokyo (JP); Syunji Ohgaya, Tokyo (JP)

(73) Assignee: TOSHO, INC., Tokyo (JP)

( * ) Notice: Subject to any disclaimer, the term of this patent is extended or adjusted under 35 U.S.C. 154(b) by 68 days.

(21) Appl. No.: 15/829,066

(22) Filed: Dec. 1, 2017

(65) Prior Publication Data

US 2018/0078459 A1 Mar. 22, 2018

Related U.S. Application Data

(62) Division of application No. 14/237,631, filed as application No. PCT/JP2012/070944 on Aug. 13, 2012, now Pat. No. 9,861,556.

(30) Foreign Application Priority Data

Aug. 16, 2011 (JP) ..... 2011-178156
Aug. 16, 2011 (JP) ..... 2011-178157
Aug. 29, 2011 (JP) ..... 2011-186409

(51) Int. Cl.
*A61J 7/00* (2006.01)
*B26D 3/30* (2006.01)
(Continued)

(52) U.S. Cl.
CPC ..... *A61J 7/0007* (2013.01); *B26D 3/30* (2013.01); *B26D 5/086* (2013.01); *B26D 7/0641* (2013.01);
(Continued)

(58) Field of Classification Search
CPC ..... A61J 3/00; A61J 7/0007; Y10T 83/178; Y10T 83/2024; Y10T 83/2022;
(Continued)

(56) References Cited

U.S. PATENT DOCUMENTS 6,050,064 A * 4/2000 Yuyama ..... B26D 3/30 53/154
6,488,192 B1 12/2002 Yuyama
(Continued)

FOREIGN PATENT DOCUMENTS

JP 11-226088 A 8/1999
JP 11-226089 A 8/1999
(Continued)

OTHER PUBLICATIONS

JP2001-061945 English Translation; Kitagawa, Takao; Mar. 13, 2001; A61J3/00.*

*Primary Examiner* — Laura M Lee
(74) *Attorney, Agent, or Firm* — Birch, Stewart, Kolasch & Birch, LLP

(57) ABSTRACT

A tablet splitting apparatus includes a guide, a catcher, and a splitting mechanism. The splitting mechanism comprises a pair of blades and a pair of blade shifters. The guide, the catcher, and the splitting mechanism are accommodated in a housing. The housing includes an opening and a support. The support and the guide each include a sliding portion. The guide disposed at the supporting position is slid along the sliding portion of the support so as to be detachable from the supporting position through the opening. The blades and the blade shifters each comprise a sliding portion. The blades and the blade shifters are in a slidable contact with each other at the sliding portions. The blades attached to the respective predetermined positions of the blade shifters are slid along the sliding portions of the blade shifters so as to be detachable from the blade shifters through the opening.

18 Claims, 28 Drawing Sheets

(51) Int. Cl.

| | |
|---|---|
| ***B26D 1/00*** | (2006.01) |
| ***B26D 7/00*** | (2006.01) |
| ***B26D 7/06*** | (2006.01) |
| ***B26D 5/08*** | (2006.01) |

(52) U.S. Cl.

CPC ..... *B26D 2001/0046* (2013.01); *B26D 2001/0066* (2013.01); *B26D 2007/0018* (2013.01); *Y10T 83/178* (2015.04); *Y10T 83/527* (2015.04)

(58) Field of Classification Search

CPC ... Y10T 83/505; Y10T 83/543; Y10T 83/536; Y10T 83/538; Y10T 83/541; Y10T 83/515; Y10T 83/535; B26D 3/26; B26D 7/0641; B23D 1/06

USPC .... 83/366, 358, 359, 360, 367, 76.8, 79, 80, 83/149, 420, 444, 448–450, 932, 279, 83/874; 30/120.1–120.5

See application file for complete search history.

(56) References Cited

U.S. PATENT DOCUMENTS

| | | | | |
|---|---|---|---|---|
| 6,647,850 | B2 | 11/2003 | Verklan | |
| 6,823,980 | B2 * | 11/2004 | Fujimoto | A61J 7/0007 198/394 |
| 6,938,530 | B1 * | 9/2005 | Fujimoto | A61J 7/0007 83/420 |
| 7,828,181 | B1 * | 11/2010 | Reitano | B26D 3/30 225/1 |
| 8,185,236 | B2 * | 5/2012 | Kim | B65B 37/04 221/220 |
| 8,678,197 | B2 * | 3/2014 | Koike | A61J 7/0007 209/314 |
| 8,887,603 | B2 | 11/2014 | Yuyama | |
| 8,925,434 | B2 * | 1/2015 | Omura | A61J 7/0007 83/106 |
| 9,849,068 | B2 * | 12/2017 | Martin | B26F 3/00 |
| 9,861,556 | B2 * | 1/2018 | Omura | B26D 3/30 |
| 9,878,460 | B2 * | 1/2018 | Omura | B26D 1/08 |
| 2004/0149100 | A1 * | 8/2004 | Fujimoto | A61J 7/0007 83/418 |
| 2005/0193885 | A1 * | 9/2005 | Lykam | B26D 3/30 83/697 |
| 2011/0309101 | A1 * | 12/2011 | Kokie | A61J 7/0007 221/30 |
| 2013/0125722 | A1 * | 5/2013 | Omura | A61J 7/0007 83/104 |
| 2013/0247731 | A1 | 9/2013 | Kim | |
| 2014/0311304 | A1 * | 10/2014 | Noble | A61J 7/0007 83/13 |
| 2016/0144523 | A1 * | 5/2016 | Seki | B23P 11/00 29/428 |
| 2016/0207215 | A1 * | 7/2016 | Omura | B26D 1/08 |

FOREIGN PATENT DOCUMENTS

| | | | |
|---|---|---|---|
| JP | 2001-061945 | A | 3/2001 |
| JP | 2011-083357 | A | 4/2011 |
| JP | 2011-97969 | A | 5/2011 |
| JP | 2012-29800 | A | 2/2012 |
| JP | 7-136591 | A | 9/2012 |
| JP | 2012-179127 | A | 9/2012 |
| WO | WO 2012/014533 | A1 | 2/2012 |

* cited by examiner

TABLET SPLITTING APPARATUS

This application is a Divisional of Application Ser. No. 14/237,631, filed on Feb. 7, 2014, which is the National Phase under 35 U.S.C. § 371 of International Application No. PCT/JP2012/070944, filed on Aug. 13, 2012, which claims the benefit under 35 U.S.C. § 119(a) to Patent Application Nos. 2011-178156, 2011-178157 and 2011-186409, all filed in Japan on Aug. 16, 2011, Aug. 16, 2011 and Aug. 29, 2011, all of which are hereby expressly incorporated by reference into the present application.

TECHNICAL FIELD

The present invention relates to an apparatus for splitting a tablet into some pieces.

BACKGROUND ART

An apparatus for splitting tablets is known that is provided with a cutter for dividing one tablet into two split pieces. Such a cutter is disposed in, for example, a tablet feeder having a passage allowing tablets to fall therethrough and a mechanism for splitting the tablets within the passage, the mechanism being disposed upstream or downstream of the passage (refer to PTL 1). Such a tablet feeder delivers one split piece of the tablet to a packing device at a time. Another tablet feeder is provided with a cutter for dividing a tablet fed from the passage into two split pieces along the horizontal direction (refer to PTL 2). Such a tablet feeder first discharges one split piece of the tablet residing below the cutter, and then discharges the other split piece of the tablet residing above the cutter.

These tablet splitting apparatuses each cut a tablet held at a splitting position with a single blade of a splitting mechanism. Such a splitting mechanism is integrated in or disposed below a tablet holder of a tablet packaging device, for example. The interior of the tablet splitting apparatus defines a vertical through-hole allowing tablets to fall therethrough. The tablets within the passage vertically fall in a substantially spontaneous manner.

Another tablet splitting apparatus is provided with a dual-bladed splitting mechanism for dividing a tablet into some pieces (refer to PTL 3). The two straight blades are faced and level with each other. Varying the relative distance between the two facing blades cuts a tablet. Still another tablet splitting apparatus is provided with a splitting mechanism having with rotary blades (refer to PTL 4).

In these tablet splitting apparatuses, a tablet is held at a splitting position by a holding mechanism and is cut with the blade(s) of the splitting mechanism. In such a tablet splitting apparatus, an appropriate control of the holding mechanism is essential to hold tablets, which are continuously fed, at an appropriate splitting position. The tablet held at an appropriate position allows the blade edge of the splitting mechanism to be stabilized at a position abutting the tablet, resulting in a substantially imperceptible fluctuation in the abutting position.

CITATION LIST

Patent Literature

[PTL 1] Japanese Unexamined Patent Application Publication No. 11-226088

[PTL 2] Japanese Unexamined Patent Application Publication No. 11-226089

[PTL 3] Japanese Unexamined Patent Application Publication No. 2011-083357

[PTL 4] Japanese Unexamined Patent Application Publication No. 2011-097969

[PTL 5] Japanese Patent Application No. 2010-170968

SUMMARY OF INVENTION

Technical Problem

An example tablet splitting apparatus is now described below which includes a holding mechanism for holding tablets to be cut at a splitting position, a splitting mechanism having facing blades which are movable relative to each other, and a splitting movement regulator for regulating the operational processes of the splitting mechanism and the holding mechanism (refer to PTL 5).

In the tablet splitting apparatus, the splitting mechanism divides a tablet with the two facing blades movable toward and away from each other. During the split of the tablet with the two facing blades movable toward and away from each other, the splitting movement regulator regulates the holding mechanism to keep a tablet until the facing blades catch the tablet, and to release the tablet after the tablet is caught by the facing blades, so that the tablet is held only by the facing blades. After the release of the tablet from the holding mechanism, the splitting movement regulator allows the facing blades to split the tablet.

In such a tablet splitting apparatus, the holding mechanism is separated from the tablet while the facing blades are splitting the tablet, so that the tablet is not affected by a possible reactive force from the holding mechanism, the reactive force being caused by the deformation and displacement of the tablet during the split by the facing blades (refer to Effects of PTL 5). The reactive force from the holding mechanism may cause a fluctuation in the splitting state and may increase the extent of the fluctuation. The tablet splitting apparatus, which is not affected by the reactive force during the splitting process, can stabilize the splitting state and have a small variation in dimension of split pieces.

An object of the present invention, which has been made to overcome such problems, is to stably supply split pieces having precise dimensions.

Solution to Problem

An example tablet splitting apparatus, which has been developed by the inventors to overcome the problems mentioned above, is described in Japanese Patent Application No. 2011-042955. The tablet splitting apparatus has a guide defining a grooved passage allowing the tablets to fall from the top end to the bottom end of the guide; a catcher for temporarily holding the tablet moving downward through the passage at a splitting position residing in the middle of the passage by closing and opening paths; and a splitting mechanism for splitting the tablet at the splitting position. Such a tablet splitting apparatus is intended to decrease the workload associated with the alignment of the components of the apparatus to deal with various shapes of tablets.

This tablet splitting apparatus further includes a groove-depth defining member for defining the depth of the upper portion of the tablet falling passage above the splitting position, a thickness adjusting mechanism for adjusting the relative distance between the groove bottom surface of the tablet falling passage and the opposite surface of the groove-depth defining member, and a controller for acquiring information on the thickness of the tablets based on which the thickness adjusting mechanism is activated to determine the relative distance depending on the thickness of the tablets.

In such a tablet splitting apparatus, the controller, the thickness adjusting mechanism, and the groove-depth defining member can cooperate with each other to determine the relative distance between the groove bottom surface of the tablet falling passage and the opposite surface of the groove-depth defining member depending on the smallest dimension on the shape of the tablet, i.e., the thickness of the tablet. In other words, the tablet splitting apparatus can automatically determine the relative distance depending on the thicknesses of various tablets to be split (refer to Japanese Patent Application No. 2011-042955).

The determination of the relative distance depending on the thickness of the tablet can stabilize the holding state of the tablet during the split, resulting in a small variation in dimension of split pieces. Furthermore, automation of such determination can reduce the workload.

The controller acquires the information on the thickness of the tablets from information sources, such as a data storage with a detachable tablet cassette, direct input through an operating unit, and downloading from a higher-level system via communication lines (refer to Japanese Patent Application No. 2011-042955).

These information sources, however, need external devices that provide computerized information on the thickness of the tablet to the information sources. In other words, these information sources are available on condition that the data on the dimensions of various tablets are prepared and that the data can be retrieved as appropriate.

Unfortunately, these information sources are not available without any supporting means. For example, the downloading is not available where no communication equipment is settled, the information from the data storage is not available if no attachment is mounted on the tablet cassette, and the input through the operating unit is troublesome and is prone to input error. The input errors are also prone during the data entry operation for the downloading scheme and the retrieving scheme from the data storage. No embodiment of the tablet splitting apparatuses described above is disclosed which can independently deal with various thicknesses of tablets while reducing the workload associated with the alignment of the components.

Furthermore, none of the tablet splitting apparatuses can promptly and appropriately deal with pharmaceutical drugs of which data is not yet prepared (for example, novel drugs and drugs needed in haste).

The study to solve these problems has been developed to achieve the invention described below.

A tablet splitting apparatus according to the present application, which has been made to overcome the above-mentioned problems, includes a guide having a guide passage for guiding a falling tablet, a catcher for receiving a tablet moving downward through the guide passage in the middle of the guide passage, a splitting mechanism for splitting the tablet received by the catcher, a groove-depth defining member disposed upstream of the catcher in the tablet moving direction. The guide passage is surrounded by inner surface which includes at least a flat portion upstream of the catcher in the tablet moving direction. The groove-depth defining member has an opposite surface facing the flat portion. The tablet splitting apparatus further includes a thickness adjusting mechanism for varying the relative distance of a facing section between the opposite surface of the groove-depth defining member and the flat portion of the guide passage, a sensor for detecting the tablet passing through the leading portion of the facing section, and a controller for controlling the operation of the thickness adjusting mechanism. The relative distance is controllable at least between a narrow state preventing the tablet from passing the facing section and a wide state allowing the tablet to pass the facing section. The controller performs a thickness measuring operation which activates the thickness adjusting mechanism to expand the relative distance in the narrow state in the presence of the tablet residing upstream of the facing section, and a thickness adjusting operation which halts the thickness adjusting mechanism to fix the relative distance based on the detection of the tablet passing through the leading portion of the facing section.

The tablet splitting apparatus according to the present invention activates the thickness adjusting mechanism to perform the thickness measuring operation which expands the relative distance in the narrow state in the presence of a tablet residing upstream of the facing section. In such a thickness measuring operation, the tablet passes through the facing section having the relative distance adjusted to exceed the thickness of the tablet, and the passing tablet is be detected by the sensor. The information on the passing tablet detected by the sensor is input to the controller. The controller halts the thickness measuring operation of the thickness adjusting mechanism on the basis of the information. This fixes the relative distance depending on the thickness of the tablet. Provided that the thickness of the tablet is in the range between the relative distance in the narrow state and that in the wide state, the tablet splitting apparatus according to the present invention can automatically determine the relative distance of the facing section in the guide passage depending on the thickness of the tablet, regardless of the availability of the preliminarily-measured information on the thickness of a tablet to be split. The tablet splitting apparatus according to the present invention thus can automatically determine the relative distance of the facing section in the guide passage, even if the thickness of the tablet to be split is not preliminarily measured. Since such a tablet splitting apparatus allows the tablet to move in a stable state, the tablet can be stably received by the catcher and can be stably split into pieces having precise dimensions.

The catcher is switchable between a holding state which receives to hold the tablet in the middle of the guide passage and a releasing state which releases the held tablet. The splitting mechanism includes facing electric blades movable under the control of the controller. A detector for detecting driving current for the facing blades is further provided. The facing blades are each movable at least among a retracted position allowing a tablet to be injected into an interspace between edges of the facing blades, a catching position allowing the edges of the facing blades to catch the injected tablet, and a split completion position allowing the caught tablet to be split. The controller performs an advancing operation which directs the facing blades to the split completion position after the tablet is injected into the interspace between the facing blades and is held by the catcher, and a catch detection operation which detects the facing blades reaching the catching positions based on an increase in the driving current in the middle of the advancing operation. The controller further performs at least one of a speed changing operation which changes a speed of the facing blades moving from the catching position to the split completion position to split the tablet based on the catch detection operation, relative to a speed of the facing blades moving toward the catching position and a releasing operation which switches the holding state of the catcher to the releasing state to release the tablet held by the catcher.

The tablet splitting apparatus having such a structure can automatically detect the facing blades at the catching positions on the basis of the driving current. The tablet splitting apparatus, which changes the moving speed of the facing blades and/or releasing the tablet from the catcher in the time from the catch of the tablet by the facing blades to the split of the tablet by the facing blades, can stably split the tablet with a small variation in dimension of split pieces. Furthermore, the tablet splitting apparatus, which also can automatically determine the timing of the change in speed of the facing blades and the release of the tablet depending on each thickness of the tablets having different dimensions, can reduce the workload of the preliminary adjustment.

The splitting mechanism has also been investigated to solve the problems mentioned above. The tablet splitting apparatus of PTL 5, for example, includes a holding mechanism for holding a tablet to be split at a splitting position and facing blades to move toward and away from the splitting position. In the tablet splitting apparatus of PTL 5, the tablet held by the holding mechanism is caught by the facing blades and is released from the holding mechanism so as to be held only by the facing blades. The tablet in such a state is split by the facing blades.

In such a tablet splitting apparatus, the holding mechanism is separated from the tablet while the facing blades are splitting the tablet, so that the tablet is not affected by a possible reactive force from the holding mechanism, the reactive force being caused by the deformation and displacement of the tablet during the split by the facing blades.

As described above, the tablet splitting apparatus of PTL5, which is modified not to be affected by the reactive force from the holding mechanism that may cause a fluctuation in the splitting state and may increase the extent of the fluctuation, can stably split the tablet with a small variation in dimension of the split pieces.

The above-described tablet splitting apparatus of Japanese Patent Application No. 2011-042955 includes a guide for falling tablets, a catcher for temporarily holding a tablet moving downward through a tablet falling passage of the guide at a splitting position in the middle of the tablet falling passage by opening and closing paths, and a splitting mechanism for splitting the tablet at the splitting position.

The tablet splitting apparatus splits the tablet with the splitting mechanism having blades moving toward and away from the tablet. The tablet splitting apparatus also includes, in the body of the housing, a supporting frame fixing the guide with screws, and blade shifters directly fixing the blades of the splitting mechanism with screws or indirectly fixing the blades of the splitting mechanism by fastening force of screws.

The worn blades of the splitting mechanism should be replaced at the right time. The workload of the replacement of the blades increases with the increasing prevalence of high-performance tablet splitting apparatuses. A direct measure to reduce such workload is use of a blade which is detachably engageable with a blade shifter in a slidable manner.

The replacement of such blades, however, is laborious for the following reason: Since the blade, which is smaller than the guide, is to be disposed in the center of the guide or in its vicinity adjacent to the splitting position, i.e., a position in a deep interior of the housing, the components surrounding such a position hinder the attachment and detachment of the blades to/from the blade shifters in the housing with the fingers of the operator. Even with the blades modified to be detachable from the blade shifters, the replacement of the blades is still laborious because the detachment and attachment of the surrounding components are required. The replacement of the blades directly with the operator's hands is undesirable because the operator should pay careful attention so as not to be injured with the blades, causing mental burden on the operator.

In such a situation, a tablet splitting apparatus including a blade which can be readily detached from the splitting mechanism in a simple manner is required to facilitate a stable split of a tablet into split pieces having precise dimensions with high accuracy.

The tablet splitting apparatus according to the present invention, which can solve such problems, includes a guide having a guide passage for guiding a falling tablet, a catcher for receiving a tablet moving downward through the guide passage in the middle of the guide passage, a splitting mechanism including blade shifters to which respective blades for splitting the tablet received by the catcher are mounted, and a housing accommodating the guide, the catcher, and the splitting mechanism. The splitting mechanism includes a pair of blade shifters attached, at predetermined positions, to the respective blades for splitting the tablet received by the catcher. The housing includes an opening allowing the guide and the blades to move therethrough and a support detachably fixing the guide at a supporting position in the housing. The support and the guide each comprise a sliding portion for fixing the guide, and the support and the guide are in a slidable contact with each other at the sliding portions while the guide is supported at the supporting position. The guide disposed at the supporting position is slid along the sliding portion of the support so as to be detachable from the supporting position through the opening. The blades and the blade shifters each comprise a sliding portion for attaching the blade, and the blades and the blade shifters are in a slidable contact with each other at the sliding portions for attaching the blades while the blades are attached to the respective predetermined positions. The blades attached to the respective predetermined positions of the blade shifters are slid along the sliding portions of the blade shifters so as to be detachable from the blade shifters through the opening.

For the detachment of the blades for splitting tablets from such a tablet splitting apparatus, a lid covering the opening, if any, is opened. The guide is then withdrawn from the housing through the opening. The guide, which is slidably detachable from the support, can be readily withdrawn from the housing through the opening. The blades in the housing become visible through the opening and the vacant space after the withdrawing of the guide. In such a state, the blades can be withdrawn with a thin nipper, such as longnose pliers. The blades, which are slidably attached to the blade shifter, can be readily detached from the housing through the opening. In such a detachment of the blades, the operator needs not to hold the blades directly by hands.

New blades can be then attached to the respective blade shifters in the housing through the opening by, for example, a nipper, after the detachment of the guide. The guide is then slid into the housing through the opening to be supported by the support. Both the blades and the guide can be readily attached to the interior of the housing in a slidable state. In this process, the operator also needs not to hold the blade directly by hands. As described above, in the tablet splitting apparatus according to the present invention, the blades for splitting a tablet can be readily attached and detached.

The sliding portion of the support for fixing the guide includes an engaging structure which directs the guide in a predetermined sliding direction. The sliding portions of the blade shifters for attaching the blades each have an engaging structure which directs the blade in a predetermined sliding direction. The sliding direction of the guide is parallel to the sliding directions of the blades.

Since the sliding direction of the guide is parallel to the sliding directions of the blades, the guide and the blades can be detached and attached at a time. Such a structure enhances the efficiency of the replacement of the blades.

After the detachment of the guide from the housing, the sliding portion of the support is slidably engageable with a sliding portion of a jig for replacing the blades. The jig for replacing the blades includes a plate jig body having a sliding portion having a structure substantially identical to the structure of the sliding portion of the guide and a blade holder provided on the jig body. Upon the slid of the jig body engaging the support close to the blade shifter, the blade holder can hold the blade attached to the blade shifter. Upon the slid of the jig body carrying the blade held by the blade shifter away from the blade shifter, the blade held by the blade holder is detached from the blade shifter.

For the tablet splitting apparatus according to the present invention, the blades for splitting a tablet may be detached and attached using a jig which is engageable with the support in the housing. In this case, the guide is withdrawn first. The jig for replacing the blade is slid into the housing to engage the support, and is then withdrawn from the housing. Upon the engagement of the jig with the support, the blade attached to the blade shifter is caught by the jig. The jig carrying the blade is then withdrawn from the housing. In other words, the blade is detached from the blade shifter. The operator needs not to hold the blade directly by hand both during and after the detachment process. As described above, for the tablet splitting apparatus according to the present invention, the blade for splitting a tablet can be readily attached and detached in a simple manner.

After the detachment of the guide from the housing, the sliding portion of the support is slidably engageable with a sliding portion of a jig for replacing the blades. The jig for replacing the blades includes a plate jig body having a sliding portion having a structure substantially identical to the structure of the sliding portion of the guide and a blade holder provided on the jig body. The blade holder holds a blade to be attached in a detachable state. Upon the slid of the jig body carrying the blade held by the blade holder close to the blade shifter, the blade held by the blade holder can be engaged with the blade shifter so as to be attached the blade shifter. Upon the slid of the jig body away from the blade shifter, the blade holder can be detached from the blade held by the blade shifter to the exterior of the housing.

For the tablet splitting apparatus according to the present invention, the blades for splitting a tablet may be detached and attached using a jig engageable with the support in the housing. In this case, the guide is withdrawn first. The jig carrying the blade to be attached is slid into the housing and is then slid from the housing. Upon the slid into the housing, the blade held by the jig is attached to the blade shifter. Upon the slid from the housing, only the jig is withdrawn from the housing. In other words, the attachment of the blade to the blade shifter is completed. The operator needs not to hold the blade directly by hand both during and after the attachment of the blade. As described above, in the tablet splitting apparatus according to the present invention, the blade for splitting a tablet can be readily attached and detached in a simple manner.

A dust separating mechanism for separating dust generated by the split of tablets has also been investigated to solve the problems mentioned above. A conventional tablet splitting apparatus includes a suction discharging mechanism for removing waste half tablet pieces or fine tablet pieces generated by the split of tablets and for cleaning a passage for falling tablets and the interior of the apparatus (refer to PTLs 1 and 2). Another conventional tablet splitting apparatus includes a splitting mechanism having facing blades or rotational blades for reducing the dust generated by the split of tablets (PTLs 3, 4, and 5). Furthermore, the above-described tablet splitting apparatus descried in Japanese Patent Application No. 2011-042955 includes a transitive unit disposed between a tablet holding mechanism and a tablet splitting mechanism, the transitive unit including a guide for collecting dust and a shock absorbing buffer, in order to inhibit the generation of dust during the transfer of the split pieces. Even for these tablet splitting apparatuses, the dust separating mechanism, such as the suction discharging mechanism for sucking the dust and the transitive unit including a screen for sifting the dust, which are described above, is essential to separate the dust which remains in spite of such inhabitation of the generation of the dust.

For example, the suction discharging mechanism, one of the conventional dust separating mechanisms for separating dust generated by the split of tablets, can efficiently separate the dust. Unfortunately, such a suction discharging mechanism leads to high device operational costs. In addition, the ease of use of the suction discharging mechanism depends on the performance of ventilation facilities.

In contrast, the screen is easy to use because it does not have such a restriction and is simple in structure and inexpensive. The screen used in a common way, however, does not fully satisfy the user's requirements. For example, the screen is disposed on an inclined guide such that tablet split pieces slide down along the guide under their own weights. In this case, the split pieces cannot fall along a gently inclined guide, while the dust cannot be separated from the split pieces falling along a steeply inclined guide. It is difficult to determine an appropriate inclination of the guide. Alternatively, the screen together with a shock absorbing buffer may be vertically turned over. In such a case, however, the split pieces and dust are dispersed in undesirable directions upon a high-speed turning over. This hinders high-speed and efficient separation of the dust.

In such a situation, an efficient dust separating mechanism having a screen has been required to surely separate the dust from the split pieces, leading to an efficient supply of the split pieces having precise dimensions.

The tablet splitting apparatus according to the present invention, which can also solve the problems, further includes a switching member having tablet falling paths allowing split pieces produced by the split of the tablet to pass therethrough, a partitioning plate having a number of pores allowing dust generated by the split of the tablet to pass therethrough, and a supporting base having a dust falling path allowing the dust to pass therethrough. A top end surface of the dust falling path is covered by the partitioning plate. The switching member is supported so as to be rotatable between positions which allow one of the tablet falling paths to be positioned above the partitioning plate. The switching member includes a rotary shaft perpendicular to the partitioning plate or an extension of the partitioning plate. The one of the tablet falling paths disposed above the partitioning plate has a bottom end surface covered by the partitioning plate, while the other of the tablet falling paths has a bottom end surface open in a releasing position.

The split pieces received by the dust separating mechanism fall through the tablet falling paths positioned above the support onto the partitioning plate. The switching member then starts rotating to move the tablet falling path positioned above the partitioning plate to the releasing position such that the bottom end surface of the tablet falling path is open. The split pieces residing on the partitioning plate are downwardly discharged from the open bottom end surface of the tablet falling path.

As described above, in the tablet splitting apparatus according to the present invention, the split pieces residing on the partitioning plate move around the surface of the partitioning plate in a tumbling and frictional state in conjunction with the rotation of the switching member. Such a movement of the split pieces allows the dust to be separated from the spit pieces and fall through the pores of the partitioning plate. This can surely sift the dust from the split pieces independently of the inclination of the partitioning plate.

In addition, the switching member moves relative to the partitioning plate in a frictional manner. This opens the bottom end surface of the tablet falling path in a sliding manner to discharge the split pieces therefrom. Unlike the dust separating mechanism involving vertically turning over the components and opening the bottom end surface in a swinging manner, this dust separating mechanism allows the split pieces to fall in a stable state and to be discharged toward an appropriate focus position even in a high-speed switching operation of the tablet falling paths. As described above, the dust separating mechanism having a screen according to the present invention can efficiently separate the dust from the split pieces.

The rotary shaft of the switching member and the partitioning plate are inclined, and the one of the tablet falling paths disposed above the partitioning plate resides at a position lower than that of the other of the tablet falling paths.

The tablet falling path residing above the partitioning plate and at the position lower than that of the other tablet falling path is upwardly moved along the partitioning plate to the releasing position. In other words, the other of the tablet falling path moves upstream against the inclined surface. Such a movement of the tablet falling path allows the dust adhering to the top surface of the partitioning plate in the tablet falling path to be efficiently sifted. The dust separating mechanism having such a screen according to the present invention can efficiently separate the dust from the split pieces.

The tablet splitting apparatus according to the present invention further includes a first dust receiver disposed below the dust falling path, a split piece receiver disposed at a position to receive the split pieces falling through the tablet falling path which is moved from the position above the partitioning plate to the releasing position, and a second dust receiver disposed below the split piece receiver. The first dust receiver accommodates the dust falling through the dust falling path. The split piece receiver has a bottom allowing the dust to pass therethrough. The second dust receiver accommodates the dust falling through the bottom.

The dust sifted through the partitioning plate falls through the pores of the partitioning plate into the first dust receiver. The split piece receiver and the first dust receiver, which are separately disposed, facilitate appropriate collection of the dust and the split pieces which are separated by the dust separating mechanism. The split piece receiver may have an optional screen bottom and the second dust receiver may be separately disposed below the split piece receiver. This facilitates appropriate collection of the dust generated from the split pieces passing over the dust separating mechanism.

Advantageous Effects of Invention

As described above, the tablet splitting apparatus according to the present application can stably supply split tablet pieces having precise dimensions.

BRIEF DESCRIPTION OF DRAWINGS

FIG. 1(*b*) is a right side view of the tablet splitting apparatus illustrated in FIG. 1 (*a*);

FIG. 1(*c*) is a right side view of a holding mechanism and a splitting mechanism in the tablet splitting apparatus illustrated in FIG. 1(*a*);

FIG. 1(*d*) is a front internal perspective view of the holding mechanism illustrated in FIG. 1(*c*);

FIG. 2(*b*) is a front view of the guide of FIG. 2(*a*) provided with a catcher;

FIG. 2(*c*) is a front view of the groove-depth defining member of the holding mechanism illustrated in FIG. 1(*c*);

FIG. 2(*d*) is a front view of the fixed cover plate of the holding mechanism illustrated in FIG. 1(*c*);

FIG. 2(*e*) is a perspective view of the holding mechanism illustrated in FIG. 1(*c*);

FIG. 3(*b*) is a right vertical sectional view of the guide and the groove-depth defining member for illustration of the operation thereof;

FIG. 3(*c*) is a right vertical sectional view of the guide and the groove-depth defining member for illustration of the operation thereof;

FIG. 3(*d*) is a right vertical sectional view of the guide and the groove-depth defining member for illustration of the operation thereof;

FIG. 3(*e*) is a right vertical sectional view of the guide and the groove-depth defining member for illustration of the operation thereof;

FIG. 4(*b*) is a right side view of the splitting mechanism for illustration of the split of the first tablet;

FIG. 4(*c*) is a right side view of the splitting mechanism for illustration of the split of the first tablet;

FIG. 4(*d*) is a right side view of the splitting mechanism for illustration of the split of the first tablet;

FIG. 4(*e*) is a right side view of the splitting mechanism for illustration of the split of the first tablet;

FIG. 4(*f*) is a right side view of the splitting mechanism for illustration of the split of the first tablet and for the split of the subsequent tablets, followed by FIG. 4(*i*);

FIG. 4(*g*) is a right side view of the splitting mechanism for illustration of the split of the first tablet and for the split of the subsequent tablets, followed by FIG. 4(*f*);

FIG. 4(*h*) is a right side view of the splitting mechanism for illustration of the split of the subsequent tablets;

FIG. 4(*i*) is a right side view of the splitting mechanism for illustration of the split of the subsequent tablets;

FIG. 5(*b*) is a time chart illustrating example position commands in a wave form before the adjustment for splitting tablets;

FIG. 5(*c*) is a time chart illustrating example driving current detection signals in a waveform;

FIG. 5(*d*) is a time chart illustrating example position commands in a waveform after the adjustment for splitting tablets;

FIG. 6(*b*) is a right vertical sectional view of the main components of the holding mechanism for illustrating the operation of the holding mechanism;

FIG. 6(*c*) is a front view of the main components of the holding mechanism for illustrating the operation of the holding mechanism;

FIG. 6(*d*) is a front view of the main components of the holding mechanism for illustrating the operation of the holding mechanism;

FIG. 6(*e*) is a front view of the main components of the holding mechanism for illustrating the operation of the holding mechanism;

FIG. 6(*f*) is a front view of the main components of the holding mechanism for illustrating the operation of the holding mechanism;

FIG. 7(*b*) is a right side view of the tablet splitting apparatus illustrated in FIG. 7(*a*);

FIG. 7(*c*) is an outline perspective view of the tablet splitting apparatus illustrated in FIG. 7(*a*), the lid thereof being in an open state;

FIG. 7(*d*) is an outline perspective view of blades of the tablet splitting apparatus illustrated in FIG. 7(*c*), the blades being detached from the tablet splitting apparatus with a remover (a jig for replacing blades);

FIG. 8(*b*) is an outline perspective view of a holding mechanism of the tablet splitting apparatus illustrated in FIG. 7(*a*);

FIG. 8(*c*) is an outline perspective view of the holding mechanism detached from the body of the tablet splitting apparatus (or to be attached to the body) illustrated in FIG. 7(*a*);

FIG. 8(*d*) is an outline perspective view of the holding mechanism and splitting mechanism which are attached to the body of the splitting mechanism illustrated in FIG. 7(*a*);

FIG. 9(*b*) is a right side view of the front blade of the splitting mechanism illustrated in FIG. 8(*d*);

FIG. 9(*c*) is a plan view of the front blade of the splitting mechanism illustrated in FIG. 8(*d*);

FIG. 9(*d*) is an outline perspective view of the front blade of the splitting mechanism illustrated in FIG. 8(*d*);

FIG. 10 (*b*) is an outline view of the blade holder of the remover illustrated in FIG. 10(*a*) and the surrounding components with a front cross-sectional view of an edge of the front blade;

FIG. 10(*c*) is an outline view of the blade holder of the remover illustrated in FIG. 10(*a*) and the surrounding components with a front cross-sectional view of the edge of the front blade;

FIG. 10(*d*) is an outline view of the blade holder of the remover illustrated in FIG. 10(*a*) and the surrounding components with a front cross-sectional view of the edge of the front blade;

FIG. 11(*b*) is an outline view of the blade holder of the setter illustrated in FIG. 11 (*a*) and the surrounding components with a front cross-sectional view of the edge of the front blade;

FIG. 11(*c*) is an outline view of the blade holder of the setter illustrated in FIG. 11 (*a*) and the surrounding components with a front cross-sectional view of the edge of the front blade;

FIG. 11(*d*) is an outline view of the blade holder of the setter illustrated in FIG. 11 (*a*) and the surrounding components with a front cross-sectional view of the edge of the front blade;

FIG. 12(*b*) is a right side view of the tablet splitting apparatus illustrated in FIG. 12(*a*);

FIG. 12(*c*) is a plan view of a dust separating mechanism of the tablet splitting apparatus illustrated in FIG. 12(*a*);

FIG. 12(*d*) is a right side view of the dust separating mechanism illustrated in FIG. 12(*c*);

FIG. 12(*e*) is an exploded perspective view and a partially enlarged view of the dust separating mechanism illustrated in FIG. 12(*c*);

FIG. 13(*b*) is a right side view of the dust separating mechanism and the receiver for illustrating the operation of the dust separating mechanism in chorological order;

FIG. 13(*c*) is a right side view of the dust separating mechanism and the receiver for illustrating the operation of the dust separating mechanism in chorological order;

FIG. 13(*d*) is a right side view of the dust separating mechanism and the receiver for illustrating the operation of the dust separating mechanism in chorological order;

FIG. 14(*b*) is an outline perspective view of the dust receiver for illustrating the detachment of the dust receivers.

DESCRIPTION OF EMBODIMENTS

Figure 1A:
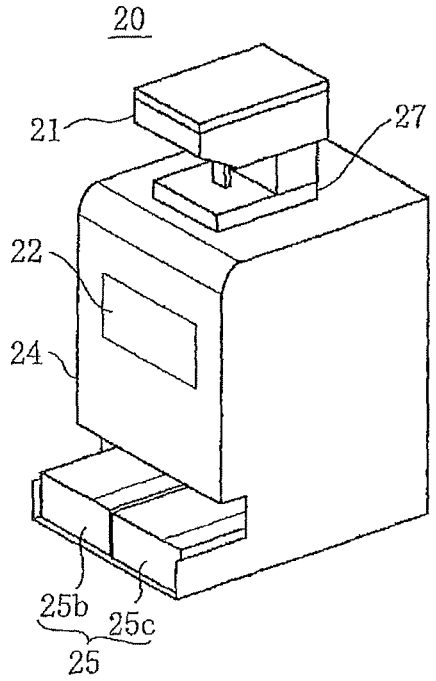
FIG. 1(*a*) is an outline perspective view of a tablet splitting apparatus according to a first embodiment of the invention of the present application.
Figure 1B:
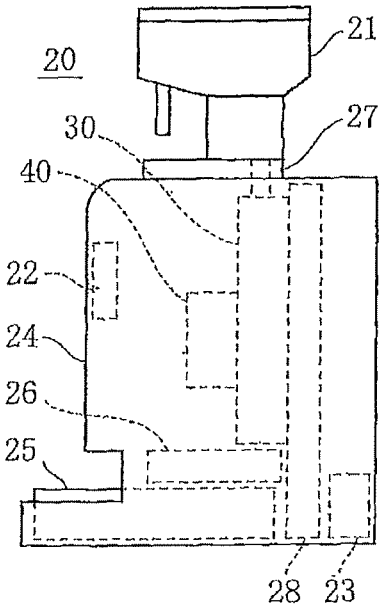
Figure 1C:
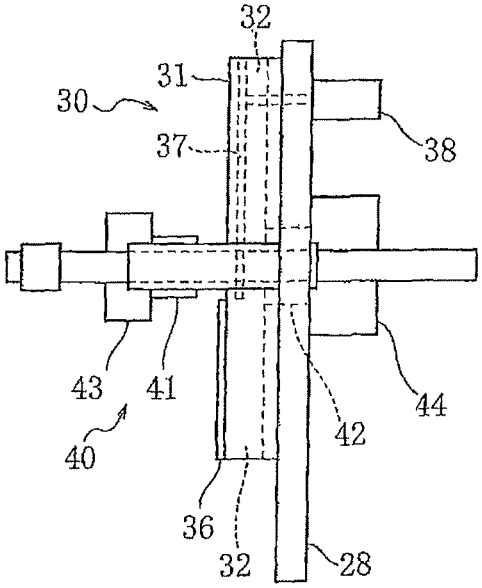
Figure 1D:
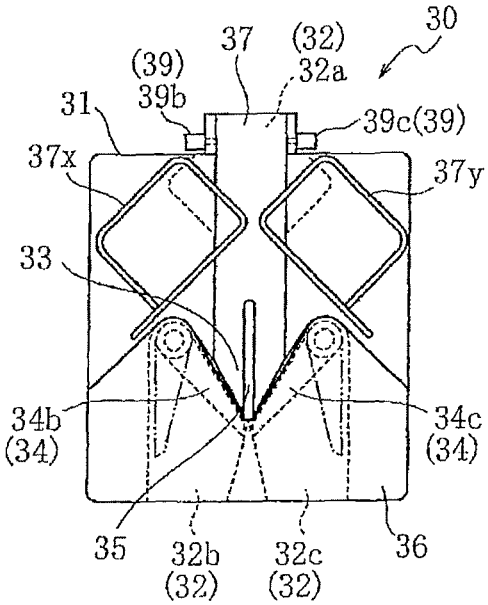
Figure 2A:
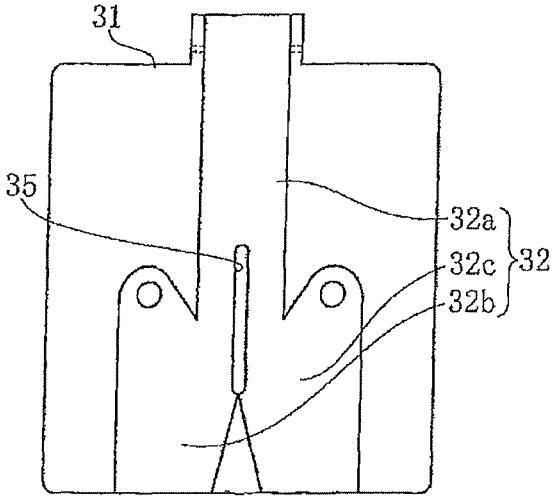
FIG. 2(*a*) is a front view of a guide for falling tablets of the tablet splitting apparatus illustrated in FIG. 1.
Figure 2B:
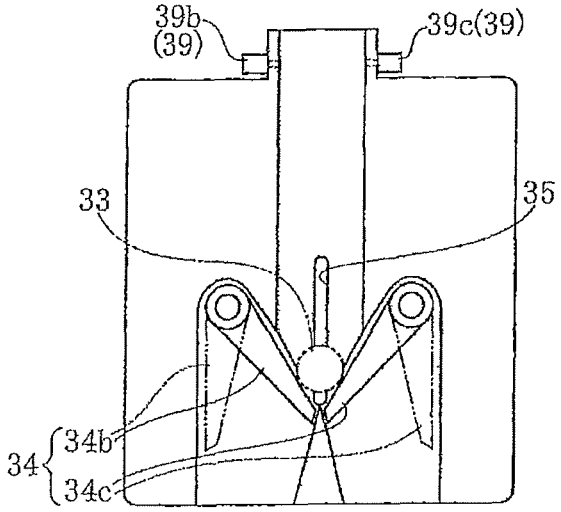
Figure 2C:
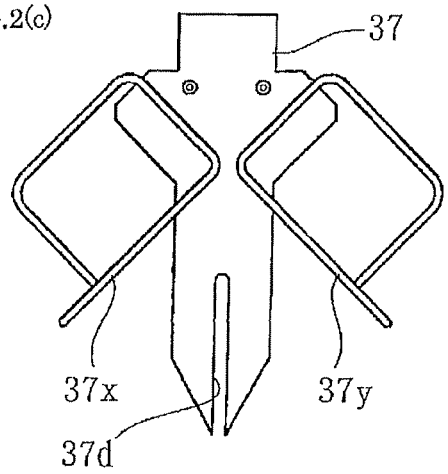
Figure 2D:
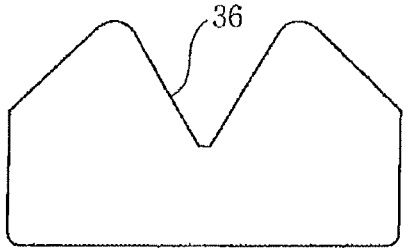
Figure 2E:
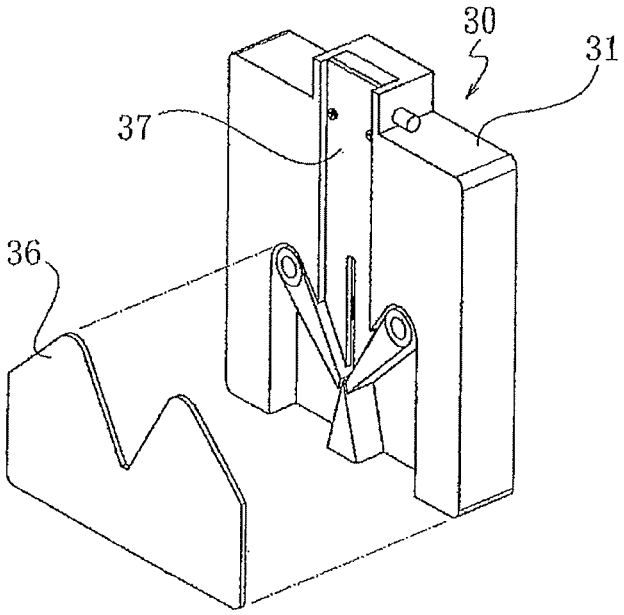
Figure 3A:
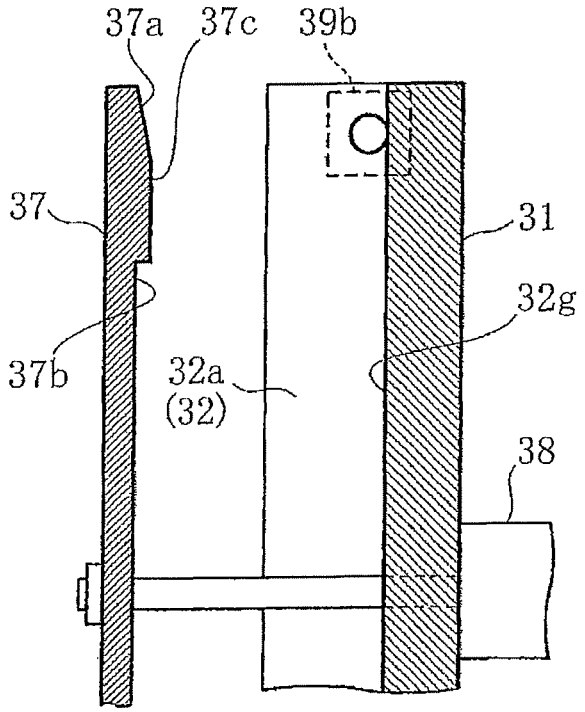
FIG. 3(*a*) is a right vertical sectional view of the guide and the groove-depth defining member for illustration of the operation thereof.
Figure 3B:
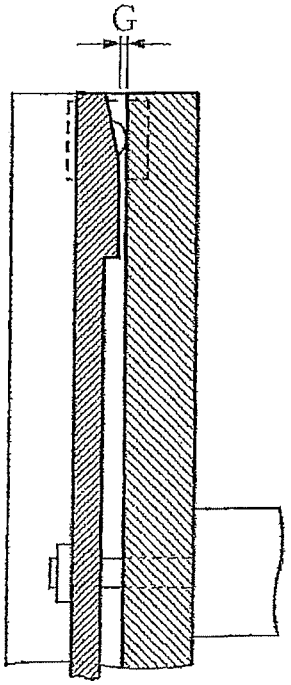
Figure 3C:
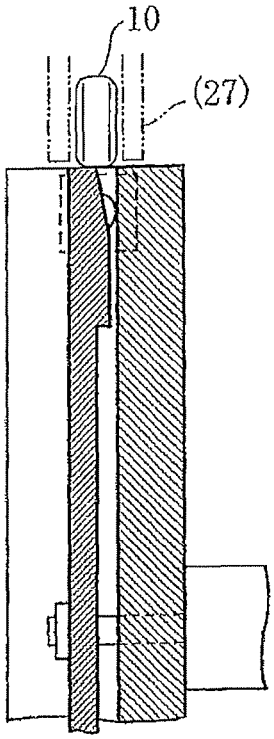
Figure 3D:
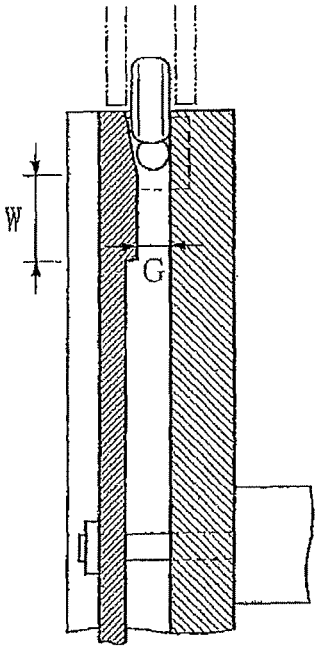
Figure 3E:
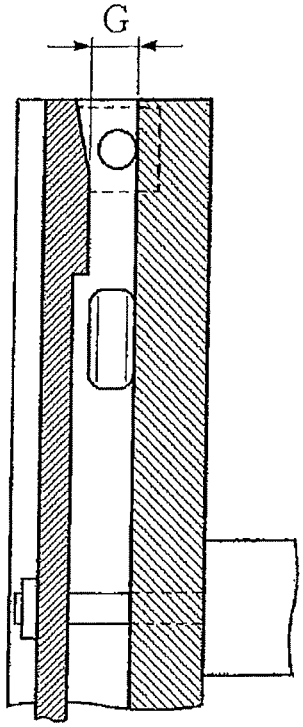

Specific embodiments of a tablet splitting apparatus of the present invention will now be described.

In every drawing, only components are explicitly illustrated which are essential for or relevant to the description of the present invention, for convenience; for example, illustrations of fasteners such as bolts, connections such as hinges, transmissions such as gears, and detailed description of an electric circuit of a motor driver and an electronic circuit of a controller are omitted. This simplifies the explanation for the characteristics of the present invention.

[First Embodiment]

As shown in FIGS. 1(*a*) to 1(*d*), a tablet splitting apparatus 20 according to a first embodiment includes a tablet cassette 21, an operating unit 22, a controller 23, a body 24, a receiver 25, a transitive unit 26, a tablet feeder base 27, a supporting frame 28, a holding mechanism 30, a splitting mechanism 40, and a power unit (not shown).

The body (housing) 24 accommodates the controller 23, transitive unit 26, supporting frame 28, holding mechanism 30, splitting mechanism 40, and power unit. The operating unit 22 and the tablet feeder base 27 are fixed to the body 24 such that an operating screen and a cassette-inserting face (not shown) reside outside of the housing. The tablet cassette 21 is detachably mounted to the tablet feeder base 27. The receiver 25 is attached to the bottom of the body 24 so as to be drawable through a front opening of the body 24.

The body 24 includes the tablet feeder base 27 fixed on its top, the supporting frame 28 substantially vertical in its central portion, the transitive unit 26 fixed in front of the lower portion of the supporting frame 28, and the drawable receiver 25 disposed below the transitive unit 26.

The holding mechanism 30 and the splitting mechanism 40 disposed in the central portion of the body 24 are mounted to the supporting frame 28 (refer to FIGS. 1(*b*) and 1(*c*)). The holding mechanism 30 has a vertical posture along the supporting flame 28. The splitting mechanism 40 is perpendicular to the holding mechanism 30 and thus has a horizontal posture.

The tablet feeder base 27 and the tablet cassette 21 attached thereto are configured to automatically supply tablets 10 in sequence. The controller 23 activates a driving motor of the tablet feeder base 27 to discharge one tablet 10 from the tablet cassette 21 attached to the base plate at a time. The discharged tablet 10 is delivered through a guide, for example, a feed port or a duct, to the top end of a tablet falling passage 32 (hereinafter referred to as a guide passage), which will be described below, of the holding mechanism 30. The tablet 10 is then delivered from the top end into an upstream guiding path (upstream path) 32*a*, which will be described below (refer to FIG. 3).

The holding mechanism 30 includes the guide passage 32 allowing tablets to fall therethrough, a catcher 34, and a slit 35 (refer to FIGS. 2 and 3). The guide passage 32 includes the upstream guide path (upstream path) 32*a* and a downstream guide path (downstream path). The downstream path diverges into a left pathway 32*b* and a right pathway 32*c*, which will be described below. The tablet 10 to be split falls from the tablet cassette 21 through the tablet feeder base 27 and the guide into the upstream path 32*a* and is then received to be held by the catcher 34. The catcher 34 temporarily holds the tablet 10 at a splitting position 33 residing in the middle of the guide passage 32 (the tablet in a held state, refer to FIGS. 4 and 6). The splitting position 33 refers to a position at which a tablet is received to be held by the catcher 34 (refer to the position of the tablet illustrated in FIG. 6(*c*)).

The splitting mechanism 40 splits the tablet 10 at the splitting position into two split pieces, i.e., a left split piece 10*b* and a right split piece 10*c* (refer to FIG. 6). In the front view of the tablet splitting apparatus of FIG. 6, the split piece on the left is the left split piece 10*b*, and that on the right is the right split piece 10*c*.

The transitive unit 26 disposed below the holding mechanism 30 includes a collecting guide and a shock absorbing buffer. The transitive unit 26 delivers the split piece 10*b* received from the left pathway 32*b* of the holding mechanism 30 into a left receiver 25*b*, while the split piece 10*c* received from the right pathway 32*c* of the holding mechanism 30 into a right receiver 25*c* (refer to FIG. 6(*f*)).

The receiver 25 is a cuboid or a square-plate case for receiving to reserve the split pieces 10*b* and 10*c* produced by the split of the tablet 10. The left receiver 25*b* containing the left split pieces 10*b* and the right receiver 25*c* containing the right split pieces 10*c* are aligned in the horizontal direction and are attached to the body 24.

The split pieces 10*b* and 10*c* may be accommodated all together. In such a case, a single wide case is used. In this embodiment, the receiver 25, the transitive unit 26 for delivering the split pieces 10*b* and 10*c* into the receiver 25, the operating unit 22, and the controller 23 are integrated into the tablet splitting apparatus to facilitate the transportation of the tablet splitting apparatus. Alternatively, these components may be detachably mounted in the tablet splitting apparatus or may be separate from the tablet splitting apparatus.

The holding mechanism 30 includes a guide plate 31 for guiding falling tablets (hereinafter referred to as a guide plate), the guide plate 31 being disposed between the tablet feeder base 27 and the transitive unit 26, and paired movable catchers 34 each having a pivotable lower end and an upper end functioning as a pivot point (FIGS. 1 to 3). With the configuration described above, the tablet 10 can be held at the splitting position 33 residing in the middle of the guide passage 32, and can be released from the holding mechanism 30 in cooperation with the splitting mechanism 40. The holding mechanism 30 further includes a guide board (groove-depth defining member) 37 and a thickness adjusting mechanism 38 for changing the posture and position of the tablet 10 through the upstream path 32*a* of the guide passage 32.

The holding mechanism 30 further includes a fixed cover plate 36 covering the front lower half of the guide plate 31 (refer to FIG. 2(*e*)). The fixed cover plate 36 covers the left pathway 32*b* and the right pathway 32*c* diverged from the guide passage 32, so that the split pieces 10*b* and 10*c* are prevented from falling from the left pathway 32*b* and the right pathway 32*c*. These components, the catcher 34, the fixed cover plate 36, the guide board 37, and the thickness adjusting mechanism 38 are aligned along the guide passage 32 and attached to the guide plate 31 (refer to FIGS. 1 to 3).

The guide plate 31 is provided with a sensor 39. The sensor 39 detects a tablet 10 falling from the tablet cassette 21 over a predetermined position in the upstream path 32*a* upstream of the guide passage 32. Preferably, the sensor 39 is a contactless optical sensor. In this embodiment, a light emitting device 39*b* and a light receiving device 39*c* symmetrically reside on the two sides of the upstream path 32*a* of the guide passage 32.

The guide plate 31, made of a relatively thick vertical plate, is fixed to the interior of the body 24 so as to be substantially parallel to the front surface and the rear surface of the body 24.

The front surface of the guide plate 31 is provided with the guide passage 32 allowing the tablets 10 to fall therethrough (refer to FIG. 1(*d*) and FIG. 2).

The guide passage 32 is a groove (grooved portion) formed by carving or denting the surface of the guide plate 31, the guide passage 32 extending from the top end to the bottom end of the guide plate 31 (refer to FIG. 2(*a*)). In specific, the guide passage 32 is a groove defined by three inner surfaces (of the guide passage 32) extending along the falling direction of the tablets and has an opening (of the groove) extending along the falling direction of the tablets. The three inner surfaces are the groove bottom surface facing the opening and the right and left side surfaces (two surfaces) residing on the two sides of the bottom surface. The bottom surface (planar section) 32*g* of the guide passage 32 is flat and extends along the falling direction of the tablets (the vertical direction). The middle of the guide passage 32 is provided with a slit 35, which will be described below.

The upstream path 32*a*, residing above the splitting position 33 in the guide passage 32, is a single path; whereas the downstream path of the guide passage 32 is divided into two pathways extending in the right direction and the left direction, respectively, at the splitting position (in specific, at a slit 35 adjacent to the splitting position 33). The two pathways, the left pathway 32*b* and the right pathway 32*c* extend parallel to each other in a vertical direction.

The catcher 34 consists of a pair of arms (a left-pathway opening/closing member and a right-pathway opening/closing member) 34*b*, 34*c* for opening/closing the left pathway and the right pathway which are diverged from the guide passage 32. The opening/closing members 34*b* and 34*c* are bilaterally symmetric about the slit 35 which will be described below. The controller 23 pivots the arms 34*b* and 34*c* to open/close the pathways. In specific, the left arm 34*b* opens/closes the bifurcation between the upstream path 32*a* and the left pathway 32*b*, while the right arm 34*c* opens/closes the bifurcation between the upstream path 32*a* and the right pathway 32*c*.

The tablet splitting apparatus 20 according to the embodiment is provided with the slit 35 extending through the guide plate 31 from the front surface to the rear surface of the guide plate 31. An edge of a blade of the splitting mechanism 40 moves through the silt 35 that extends along the guide passage 32 in the central portion of the guide passage 32. Such a configuration allows the tablet held at the splitting position 33 to be split by the splitting mechanism 40 (in this embodiment, the tablet is divided vertically into two split pieces). The slit of the embodiment is formed by perforation. In other words, the silt 35 vertically resides in the center of the splitting position 33. The tablet splitting apparatus 20 according to the embodiment is thus preferred for splitting a disk tablet 10 into right and left split pieces having equal dimensions. The catcher 34 consists of a pair of the opening/closing members 34*b* and 34*c*. To temporarily hold the tablet 10 at the splitting position 33, the bottom ends of the opening/closing members 34*b* and 34*c* of the catcher 34 come into contact with each other to define a V shape, closing the guide passage 32 at the point immediately below the splitting position 33 and the slit 35 (a tablet holding state). The left arm 34*b* of the catcher 34 pivots (opens) to put the upstream path 32*a* into communication with the left pathway 32*b* so as to guide the split pieces 10*b* and 10*c* into the left pathway 32*b* (a tablet releasing state); whereas the right arm 34*c* pivots (opens) to put the upstream path 32*a* into communication with the right arm 34*c* so as to guide the split pieces 10*b* and 10*c* into the right pathway 32*c*. The left arm 34*b* and the right arm 34*c* simultaneously pivot (open) to the opening positions so as to guide the split pieces 10*b* and 10*c* into the left pathway 32*b* and the right pathway 32*c*. As described above, the catcher 34 is switchable between the tablet holding state which holds the tablet 10 at the splitting position 33 and the tablet releasing state which releases the tablet 10.

The guide board (groove-depth defining member) 37 is a thin plate composed of, for example, transparent or opaque rigid resin, extending along the upstream path 32*a* of the guide passage 32 from the top opening of the groove so as to cover the front of the upstream path 32*a* (refer to FIGS. 2(*c*), 2(*e*), and 3). A groove bottom surface 32*g* of the upstream path 32*a* faces a back or rear surface of the guide board 37 in the covered region. The back or rear surface includes a tapered area 37*a* residing at its top end, a facing base area 37*b* residing at its bottom end, and a facing projecting area 37*c* residing between the tapered area 37*a* and the base area 37*b*. The tapered area 37*a* defines a rising slope from the top end of the guide board 37 toward the projecting area 37*c*. This facilitates the injection of the tablet 10 from the top end of the guide board 37 into the covered region. The base area 37*b* and the projecting area 37*c* are parallel to the groove bottom surface 32*g*. The guide board 37 is supported by biasing springs 37*x* and 37*y* of the thickness adjusting mechanism in a movable state in the anteroposterior direction, while keeping parallel to the groove bottom surface 32*g*. As the thickness adjusting mechanism 38 moves the guide board 37 in the anteroposterior direction under the control of the controller 23, the relative distance G between the groove bottom surface 32*g* of the guide passage 32 and the opposite bottom surface (opposite surface) of the guide board 37 increases and decreases. In FIG. 3(*e*), the narrowest gap distance of the facing section W between the projecting area 37*c* and the groove bottom surface (planar section) 32*g* is referred to as the relative distance G (refer to FIG. 3(*e*)). The guide board 37 further has a slit 37*d* which resides in front of the slit 35 of the guide plate 31 while the guide board 37 is residing in the upstream path 32*a* of the guide passage 32. Such a configuration allows the tablet 10 to be split by a front blade 41, which will be described below.

The splitting mechanism 40 includes facing blades, i.e., a front blade 41 and a back blade 42 moving toward and away from the splitting position 33. In other words, the front blade 41 and the back blade 42 can move close to and away from each other. Varying the interspace between the front blade 41 and the back blade 42 vertically splits the tablet 10 held at the splitting position 33 into two split pieces having equal dimensions. The front blade 41 is attached to a highly rigid U-shaped support mating with a rod sleeve. The front blade 41 is also held in front of the slit 35 at the splitting position 33 by a reciprocatable front blade shifter 43. The front blade 41 moves in the anteroposterior direction through the slit 35 under the control of the controller 23. The back blade 42 is supported by a back blade shifter 44 that can reciprocate behind the guide plate 31. The back blade 42 moves toward and away from the tablet 10 through the slit 35 under the control of the controller 23 (refer to FIG. 4).

Figure 4A:
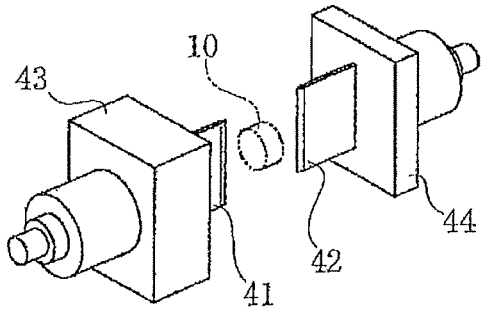
FIG. 4(*a*) is a schematic perspective view illustrating the configuration of facing blades of the splitting mechanism, the operation of the facing blades being described with reference to FIG. 4(*b*) to FIG. 4(*i*)
Figure 4B:
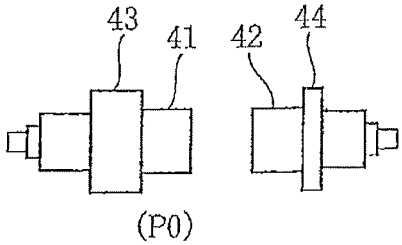
Figure 4C:
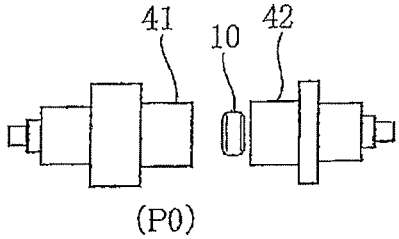
Figure 4D:
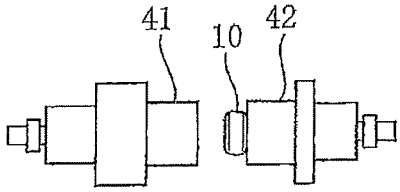
Figure 4E:
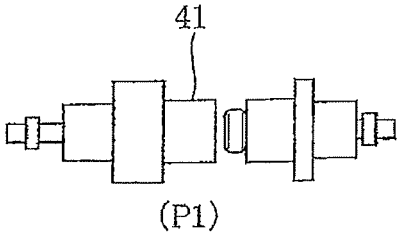
Figure 4F:
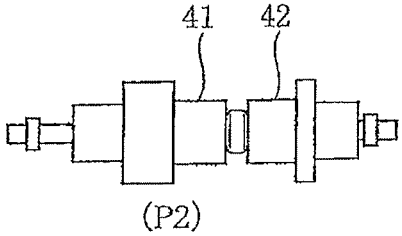
Figure 4:
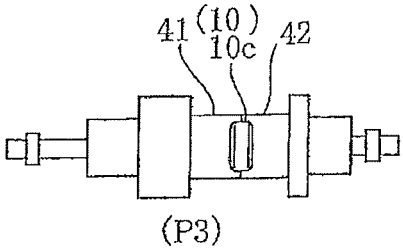
Figure 4H:
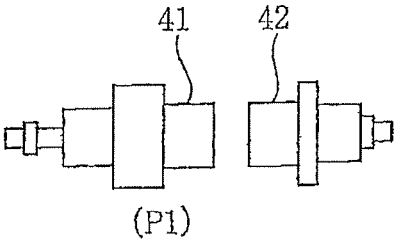
Figure 4I:
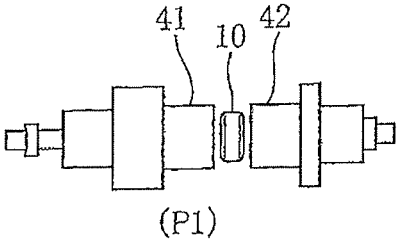
Figure 5A:
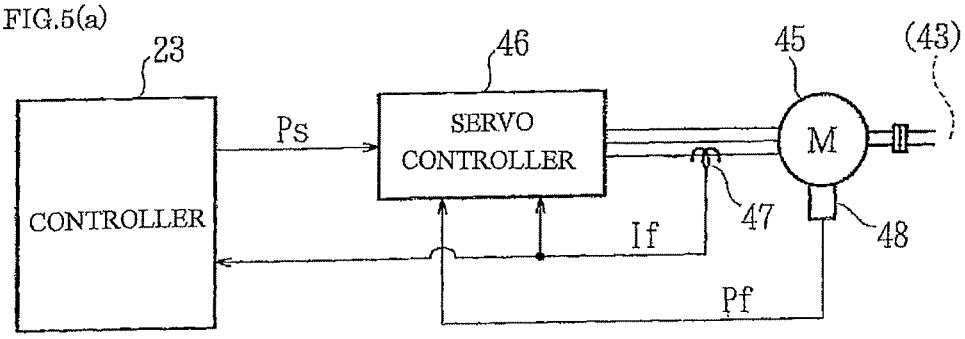
FIG. 5(*a*) is a block diagram of a driving system and a controlling system of the splitting mechanism.
Figure 5B:
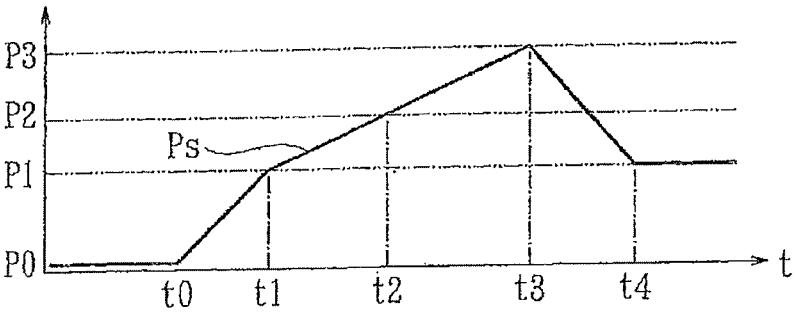
Figure 5C:
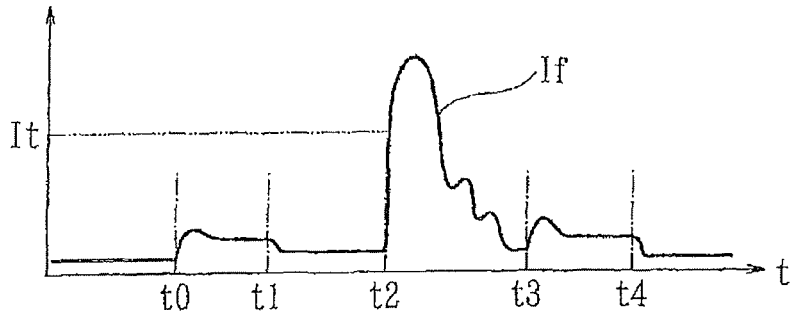
Figure 5D:
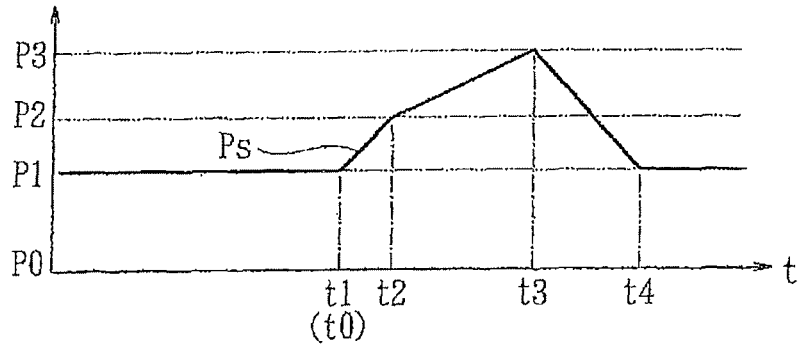
Figure 6A:
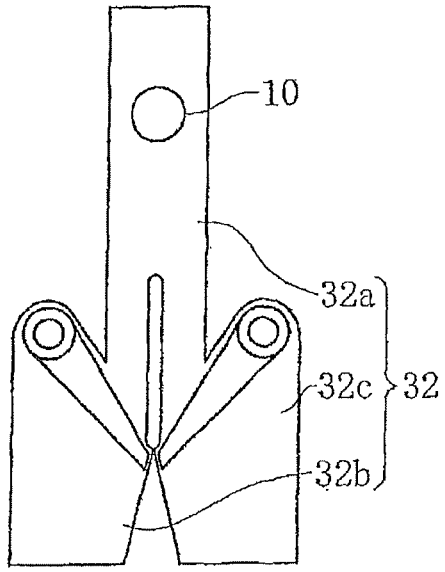
FIG. 6(*a*) is a front view of main components of the holding mechanism for illustrating the operation of the holding mechanism.
Figure 6B:
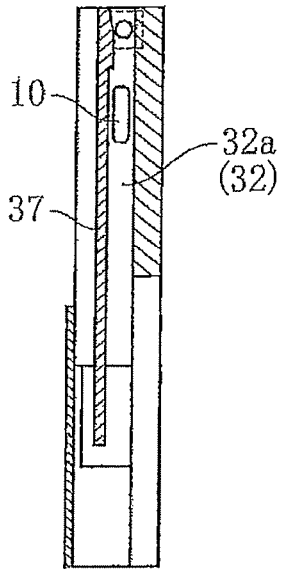
Figure 6C:
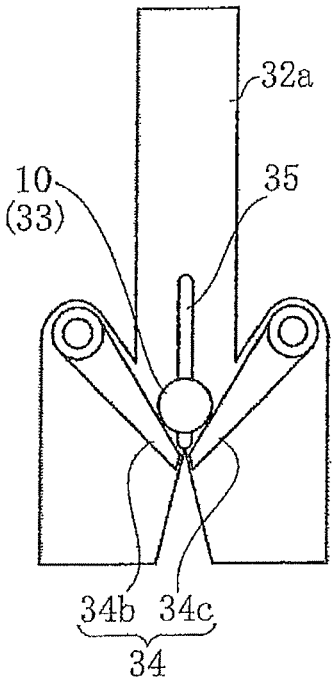
Figure 6D:
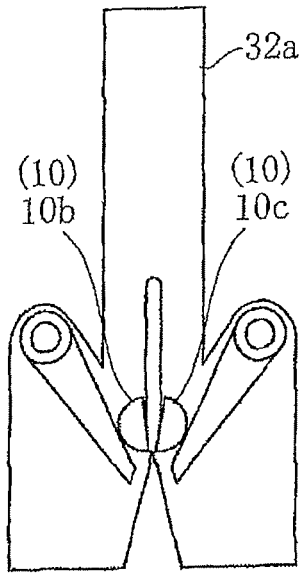
Figure 6E:
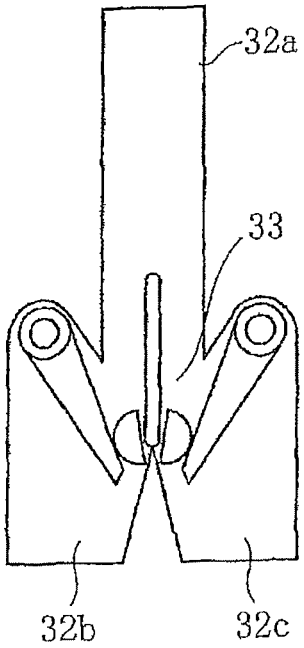
Figure 6F:
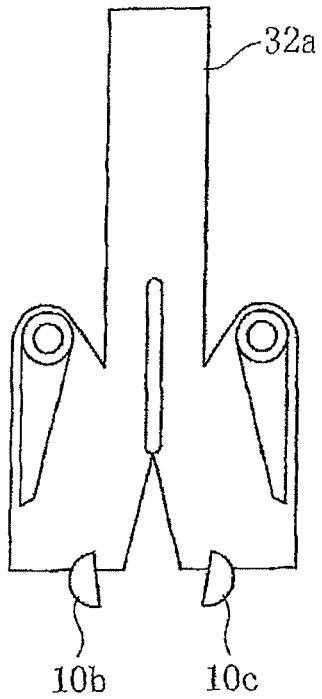

As described above, the splitting mechanism 40 moves the facing blades 41 and 42 under the control of the controller 23 to decrease and increase the interspace between the facing blades 41 and 42, catching the tablet 10 to split the tablet 10 by the facing blades 41 and 42 (refer to FIG. 4). In the splitting process, the tablet 10 to be cut is held while being spaced from the groove bottom surface of the guide passage 32 and the opposite surface of the guide board 37, and the tablet 10 in such a state is then split. Furthermore, in a predetermined time (a time t2 which will be described below) from the end of the catch of the tablet 10 to the start of the split of the tablet 10 with the facing blades 41 and 42, the catcher 34 in a closed state opens under the control of the controller 23 to release the tablet 10 temporarily held by the catcher 34. In other words, the tablet 10 to be split is held only by the facing blades 41 and 42.

The controller 23 is an electronic controlling means, for example, a programmable microprocessor or a programmable sequencer. The controller 23 also controls the operation of electric motors of the tablet feeder base 27, the holding mechanism 30, and the splitting mechanism 40 so that the tablet feeder base 27, the holding mechanism 30, and the splitting mechanism 40 cooperate with each other to continuously supply tablets and to precisely split the tablets 10. One of these electric motors is a servo motor 45 for driving the front blade shifter 43 and the front blade 41 (refer to FIG. 5(*a*)). In response to a position command Ps output from the controller 23 to a servo controller 46 for supplying driving current to the servo motor 45, the servo controller 46 feedback-controls the rotational angle of the servo motor 45 and the stationary positions of the front blade shifter 43 and the front blade 41 on the basis of the position command Ps. The detailed illustration of the controller 23 is omitted.

The feedback control may be of a common dual feedback scheme. In particular, a driving current detector 47, which is, for example, a current transformer or a current transducer, detects the driving current supplied from the servo controller 46 to the servo motor 45 to feedback a driving current detecting signal If to the servo controller 46 through a minor loop. In addition, a position detector 48, which is, for example, an encoder or a resolver, detects the rotational angle of the servo motor 45 to feedback a position detecting signal Pf to the servo controller 46 through a major loop. In this embodiment, the driving current detecting signal If indicating the detected driving current for the servo motor 45 and the front blade 41 is also sent to the controller 23.

The controller 23 receives the driving current detecting signal If to determine the predetermined time t2 from the end of the catch of the tablet 10 to the start of the split of the tablet 10 with the facing blades 41 and 42 and to determine the interspace between the facing blades 41 and 42 based on the thickness of the tablet 10. The controller 23 also receives data on a falling tablet 10 detected by the sensor 39. The data on the detected tablet 10 is used, for example, to determine the relative distance G between the groove bottom surface of the upstream path 32*a* of the guide passage 32 and the opposite surface of the guide board 37 based on the thickness of the tablet 10. The controller 23, in sequence, automatically determines the relative distance G on the basis of the data on the falling tablets detected by the sensor 39 and automatically determines the predetermined time t2 on the basis of the driving current detecting signals If provided by the driving current detector 47 immediately after the power activation, after the replacement of the tablet cassette 21, or in response to the instructions for the initialization from the operating unit 22.

The automatic adjustment of the relative distance G will now be described in detail (refer to FIG. 3). The controller 23 activates the thickness adjusting mechanism 38 to move the guide board 37 locating at any position toward the bottom surface of the upstream path 32*a* of the guide passage 32 (refer to FIG. 3(*a*)). This narrows the relative distance G to block the tablet (refer to FIG. 3(*b*)). Such a state is kept before the injection of the tablet 10 from the tablet cassette 21 through the guide of the tablet feeder base 27. In the presence of the tablet 10 upstream of the facing position (in the facing section W) between the groove bottom surface 32*g* of the upstream path 32*a* and the guide board 37 after the injection of the tablet 10 (refer to FIG. 3(*c*)), the controller 23 activates the thickness adjusting mechanism 38 to move the guide board 37 recedes from the groove bottom surface 32*g* at a relatively low speed in response to the data on the falling tablets continuously sent from the sensor 39 (a thickness measuring operation). The relative distance G is expanded from the narrowest state (minimum distance) to a wider, maximum state (refer to FIG. 3(*d*)).

The relative distance G expanded to be slightly wider than the thickness of the tablet 10 allows the tablet 10 to fall from the upstream path 32*a* of the guide passage 32. The tablet 10 passing over the sensor 39 (refer to FIG. 3(*e*)) is detected by the sensor 39, and the data on the tablet 10 is sent to the controller 23. As described above, the controller 23 activates and halts the thickness adjusting mechanism 38 while monitoring the data from the sensor 39. Such a controller 23 halts the operation of the thickness adjusting mechanism 38 immediately in response to the data from the sensor 39 (a thickness adjusting operation). The guide board 37 is thereby kept at a halt position, followed by the termination of the automatic adjustment of the relative distance G. The subsequent tablets 10 fall through the guide passage 32 having the fixed relative distance G. As described above, the controller 23 fixes the relative distance G to be slightly wider than the thickness of the tablet 10, depending on the thickness of the tablet 10.

The automatic adjustment of the predetermined time t2 will now be described in detail (refer to FIGS. 4 and 5). In this embodiment, the predetermined time t2 is automatically adjusted on the basis of the driving current for the front blade 41. In other words, the automatic adjustment of the predetermined time t2 corresponds to the automatic determination of the stationary position P2 of the front blade 41 in an anteroposterior direction. For the first falling tablet 10 the thickness of which is not yet detected, the interspace between the facing blades 41 and 42 is expanded to a maximum level so that tablets 10 can smoothly pass therethrough and reach the splitting position 33. In particular, the front blade 41 is retracted in the stationary position P0 (retracted position) (refer to FIG. 4(*b*)). After the first injection of the tablet 10 and the termination of the automatic adjustment of the relative distance G described above, the controller 23 determines a stationary position P1 based on the relative distance G. In specific, the controller 23 determines the stationary position P1 of the front blade 41 so that the interspace between the facing blades 41 and 42 is slightly wider than the relative distance G to facilitate the drop of the tablet 10 into the interspace.

Once the first tablet 10 reaches the interspace between the facing blades 41 and 42 (refer to FIG. 4(*c*) and a time t0 in FIG. 5(*b*)), the controller 23 moves the front blade 41 at high speed and the back blade 42 at low speed to narrow the interspace between the facing blades 41 and 42 (closing-movement operation). The front blade 41 is kept moving at high speed until it reaches the stationary position P1 (refer to the position command Ps from the time t0 to the time t1 in FIG. 5(*b*)). The back blade 42 residing slightly behind the groove bottom surface of the guide passage 32 moves toward the tablet 10 and temporarily halts the movement at a position to catch the tablet 10 which is not in contact with the groove bottom surface (refer to FIG. 4(*d*)). The back blade 42 waits for the arrival of the front blade 41 at the stationary position P1.

The controller 23 can control the operation described above. In specific, the controller 23 can move one of the facing blades to the predetermined position (operation for determining the catching position), and then moves the other blade close to the one blade to catch a tablet with the two blades. In this case, the closing-movement operation of one blade is different from that of the other blade. The operation for determining the catching position is part of the closing-movement operation.

After the front blade 41 reaches the stationary position P1 (refer to FIG. 4(*e*) and the time t1 of FIG. 5(*b*)), the controller 23 moves the facing blades 41 and 42 at low speed to narrow the interspace therebetween to allow the tablet 10 to be split (refer to the position command Ps from the time t1 to t3 of FIG. 5(*b*)). After the front blade 41 reaches the stationary position P2, the tablet 10 is caught with the facing blades 41 and 42 (refer to FIG. 4(*f*)). The tablet 10 resists the movement of the facing blades 41 and 42, which steeply increases the driving current supplied from the servo controller 46 to the servo motor 45. The driving current detecting signals If accordingly steeply increase and exceed a threshold value It (refer to the time t2 of FIG. 5(*c*)). The controller 23 continuously receives the driving current detecting signals If. In other words, the controller 23 constantly monitors the signals If. Such a controller 23 can readily and surely determine the time t2 (predetermined time) at which the facing blades 41 and 42 catch the tablet 10 therebetween and the stationary position P2 (the catching position) on the basis of the detection of the driving current.

The controller 23 determines the time t2 on the basis of the steep increase in driving current detecting signal If to be the predetermined time t2 from the end of the catch of the tablet 10 to the start of the split of the tablet 10 with the facing blades 41 and 42. In the predetermined time t2, the catcher 34 releases the first tablet 10 or the subsequent tablet 10 that is temporarily held by the catcher 34. For the subsequent tablet 10, the advancing speed (moving speed) of the front blade 41 is changed at the predetermined time t2. In specific, for the subsequent tablets 10 which are to be split after the automatic determination of the predetermined time t2, all that is needed is to shift the advancing speed of the front blade 41 from high speed to low speed in the predetermined time t2 (refer to the position command Ps from the time t1 to the time t2 in FIG. 5(*d*)). In other words, the speed of the front blade 41 is varied in the time t1 only for the first tablet 10 (refer to FIG. 5(*b*)).

Between the predetermined times t2 to t3, the controller 23 advances the facing blades 41 and 42 at low speed for catching the first tablet 10 and the subsequent tablet 10 (refer to the position command Ps from time t2 to t3 in FIGS. 5(*b*) and 5(*d*)). After the front blade 41 reaches the stationary position P3 (refer to FIG. 4(*g*)) and the tablet 10 is split, the controller 23 quickly retracts the facing blades 41 and 42 at high speed (refer to the position command Ps from the time t3 to the time t4 of FIGS. 5(*b*) and 5(*d*)). At this time, the controller 23 has already determined the relative distance G between the groove bottom surface of the upstream path 32*a* of the guide passage 32 and the opposite surface of the guide board 37 based on the thickness of the tablet 10. In addition, the controller 23 has already received the data on the subsequent tablets 10 that are to be caught in the interspace between the facing blades 41 and 42 slightly wider than the fixed relative distance G. The controller 23 accordingly halts the front blade 41 at the stationary position P1 on the basis of the received data (refer to FIGS. 4(*h*) and 4(*i*)). As described above, the facing blades 41 and 42 are movable between the stationary position P0 (retracted position) allowing the tablet 10 to be injected into the interspace between the edges of the facing blades 41 and 42, the stationary position P2 (catching position) allowing the injected tablet 10 to be caught between the edges of the blades, and the stationary position P3 (split-completion position) allowing the tablet caught between the edges of the facing blades 41 and 42 to be split.

The mode of the use and operation of the tablet splitting apparatus 20 according to the embodiment will now be described with reference to the drawings.

Prior to the split of the tablets, the tablet cassette 21 containing a large number of the tablets 10 is attached to the tablet feeder base 27, and the receiver 25 is attached to the body 24 (refer to FIGS. 1(*a*), and 1(*b*)). After the attachment of these components, the tablet splitting apparatus 20 is activated by, for example, power supply. The tablet splitting apparatus 20 is in the initial mode and starts the automatic determination of the relative distance G and the predetermined time t2. In specific, the relative distance G between the upstream path 32*a* of the guide passage 32 and the opposite surface of the guide board 37 is narrowed (refer to FIG. 3(*b*)), and the front blade 41 is retracted to the stationary position P0, allowing the interspace between the facing blades 41 and 42 to be expanded to a maximum level (refer to FIG. 4(*b*)). In the holding mechanism 30 in the initial state, the left arm 34*b* and the right arm 34*c* of the catcher 34 residing immediately below the splitting position 33 are closed and the splitting position 33 is vacant, i.e., holding no tablet 10.

Once the tablet splitting apparatus 20 starts the splitting process in response to the input to the operating unit 22 under such a condition, the driving motor of the tablet feeder base 27 is activated and thereby the tablet cassette 21 starts continuously discharging one tablet 10 at a time. The tablet 10 discharged first is injected through the guide of the tablet feeder base 27 into the guide passage 32 of the holding mechanism 30. At this time, the relative distance G between the groove bottom surface of the upstream path 32*a* of the guide passage 32 and the opposite surface of the guide board 37 is sufficiently narrow so as to block the tablets 10. The tablet 10 is thus temporarily held at the top end (upstream) of the guide passage 32 (refer to FIG. 3(*c*)).

The guide board 37 is then moved to expand the relative distance G (refer to FIG. 3(*d*)). The moving guide board 37 halts the movement to fix the relative distance G to be slightly wider than the thickness of the tablet 10 (refer to FIG. 3(*e*)). Upon the halt of the guide board 37, the tablet 10 falls through the upstream path 32*a* of the guide passage 32 (refer to FIGS. 6(*a*) and 6(*b*)). Since the tablet 10 falls after the automatic determination of the relative distance G, the relative distance G has been already determined based on the thickness of the tablet 10. The tablet 10 thus can smoothly and rapidly fall into the splitting position 33 while keeping its posture in the thickness direction to the anteroposterior direction of the tablet splitting apparatus 20 (refer to FIG. 6(*c*)).

The tablet 10 reached the splitting position 33 is trapped on the catcher 34, and resides in the space between the two elements of the catcher 34, i.e., the left arm 34*b* and the right arm 34*c* to be held in front of the slit 35 (refer to FIG. 6(*c*)). Although the tablet 10 residing in the interspace between the facing blades 41 and 42 is in contact with the groove bottom surface of the guide passage 32 of the guide plate 31 and the two catching elements of the catcher 34 of the holding mechanism 30, the tablet 10 is not in contact with the facing blades 41 and 42 (refer to FIG. 4(*c*)).

The tablet 10 in such a state is split by the splitting mechanism 40. The split of the first tablet 10 involves the automatic determination of the predetermined time t2 depending on the thickness of the tablet 10. Once the first tablet 10 reaches the interspace between the facing blades 41 and 42 (refer to FIG. 4(*c*)), the front blade 41 advances at high speed (refer to the position command Ps from the time t0 to the time t1 of FIG. 5(*b*)), while the back blade 42 advances at low speed, narrowing the interspace between the facing blades 41 and 42. The back blade 42 temporarily halts the movement at a position to hold the tablet 10 spaced from the groove bottom surface (refer to FIG. 4(*d*)). The front blade 41 moves to the stationary position P1 at high speed (refer to FIG. 4(*e*)), the speed of which is varied at the stationary position P1, and then moves to the stationary position P3 at low speed (refer to the position command Ps from the time t1 to the time t3 of FIG. 5(*b*)). After the arrival of the front blade 41 at the stationary position P1, the back blade 42 restarts to advance at low speed.

Upon the arrival of the front blade 41 at the stationary position P2, the interspace between the front blades 41 and 42 is sufficiently narrow so as to catch the tablet 10 with the facing blades 41 and 42 (refer to FIG. 4(*f*)). On the basis of the driving current detecting signals If which steeply increase accordingly and exceed a threshold value It (refer to the time t2 in FIG. 5(*c*)), the controller 23 determines the time t2 (predetermined time) to catch the tablet 10 with the facing blades 41 and 42 and the stationary position P2 (catching position).

As described above, the predetermined time t2, i.e., the time from the end of the catch of the tablet 10 to the start of the split of the tablet 10 with the facing blades 41 and 42, and the time to vary the moving speed of the front blade 41 and to release the tablet 10 temporarily held by the catcher 34, is automatically determined depending on the thickness of a tablet 10 on the basis of the driving current detecting signals If from the driving current detector 47.

After the arrival of the front blade 41 at the stationary position P3 (refer to FIG. 4(*g*)), the tablet 10 is divided into two split pieces 10*b* and 10*c* (refer to FIG. 6(*d*)). After the split of the tablet 10, the facing blades 41 and 42 are retracted at high speed (refer to the position command Ps from the time t3 to the time t4 of FIG. 5(*b*)), expanding the interspace between the facing blades 41 and 42. The front blade 41 halts at the stationary position P1 (refer to FIG. 4 (*h*)). Upon the split of the tablet 10 into the split pieces 10*b* and 10*c*, the catcher 34 pivots to open the guide passage 32 (refer to FIG. 6(*e*)) so as to put the splitting position 33 into communication with the downstream site of the guide passage 32, i.e., the left pathway 32*b* and the right pathway 32*c*. The left-half split piece 10*b* falls through the left pathway 32*b* into the left receiver 25*b*, while the right-half split piece 10*c* falls through the right pathway 32*c* into the right receiver 25*c* (refer to FIG. 6 (*f*)).

The completion of the split of the first tablet 10 is accompanied by the completion of the automatic determination of the relative distance G and the predetermined time t2. Since the adjustment for the subsequent tablets 10 has been already prepared, the subsequent tablets 10 can be stably and rapidly split.

In the following description, repeated description is avoided: While the subsequent tablet 10 is being discharged from the tablet cassette 21 and being falling into the guide passage 32 of the holding mechanism 30, the relative distance G between the groove bottom surface of the upstream path 32*a* of the guide passage 32 and the opposite surface of the guide board 37 is fixed to be slightly wider than the thickness of the tablet 10 (refer to FIG. 3(*e*)). The front blade 41 is kept halting at the stationary position P1, the interspace between the facing blades 41 and 42 is slightly wider than the relative distance G (refer to FIG. 4 (*h*)).

The subsequent tablet 10 is thus immediately injected into the upstream path 32*a* of the guide passage 32 (refer to FIGS. 6(*a*) and 6(*b*)). Since the relative distance G of the upstream path 32*a* is determined based on the thickness of the tablet 10, the tablet 10 can smoothly and rapidly fall while keeping its posture in the thickness direction to the anteroposterior direction of the tablet splitting apparatus 20. The falling tablet 10 is received to be held at the splitting position 33 by the catcher 34 in a closed state (refer to FIG. 6(*c*)). Since the interspace between the facing blades 41 and 42 is also determined based on the thickness of the tablet 10, the tablet 10 can fall into the interspace between the facing blades 41 and 42 without contacting with the facing blades 41 and 42 and reside in front of the slit 35 (refer to FIG. 4(*i*)), while being held by the contact regions between the groove bottom surface of the guide passage 32 and the two catching elements of the catcher 34 (refer to FIG. 6(*c*)).

The tablet 10 in such a state is split by the splitting mechanism 40. Since the time t2 for the subsequent tablets 10 has been already automatically determined based on the thickness of the subsequent tablets 10, the front blade 41 advances from the stationary position P1 to the stationary position P2 at high speed. This allows the tablet 10 to be rapidly and quickly caught between the facing blades 41 and 42 (refer to FIG. 4(*f*)). Prior to the catch of the tablet 10 between the facing blades 41 and 42, the back blade 42 spaces the tablet 10 from the groove bottom surface of the guide passage 32. Once the facing blades 41 and 42 catch the tablet 10 therebetween, the catcher 34 releases the tablet 10 temporarily held thereon, and the moving speed of the front blade 41 is varied from high speed to low speed. The facing blades 41 and 42 cut into the tablet 10 released from the holding mechanism 30 that provides undesired reactive force (refer to FIG. 4(*g*)), and divide the tablet 10 into two split pieces 10*b* and 10*c* (refer to FIG. 6(*d*)).

The guide passage 32 in a closed state has been already opened by the pivoting (opening operation) of the catcher 34 (refer to FIG. 6(*e*)). In other words, the splitting position 33 is in communication with the downstream site of the guide passage, i.e., the left pathway 32*b* and the right pathway 32*c*. The left-half split piece 10*b* falls through the left pathway 32*b* into the left receiver 25*b*, while the right-half split piece 10*c* falls through the right pathway 32*c* into the right receiver 25*c* (refer to FIG. 6(*f*)).

In this way, the split of the subsequent tablets 10 can receive the full benefit of the automatic adjustment for the first tablet 10, allowing for stable and quick splitting of the tablets.

[Others]

In the tablet splitting apparatus according to the first embodiment described above, the information on the thickness of the tablet is available from the internal devices of the tablet splitting apparatus, not from the external devices; however, the information may be received from the external devices. Alternatively, the tablet splitting apparatus may receive the information from the external devices in addition to the information from the internal devices. Upon the reception of the information from the external devices, the tablet splitting apparatus may use the information as an initial value of the relative distance between the groove bottom surface of the guide passage and the opposite surface of the guide board, or may use a slightly smaller initial value than the information.

In the embodiment described above, the predetermined time t2 is automatically determined on the basis of the driving current for the front blade 41; however, it may be determined on the basis of the driving current for the back blade 42, or may be determined on the basis of the total driving current for the front blade 41 and the back blade 42.

The operating unit 22 in the embodiment described above is not essential; alternatively, any sequential operation may be started in response to the injection of the tablet 10 into the top end of the guide passage. The receiver 25 and the transitive unit 26 are not essential, if any inconvenience for the discharge of the split pieces 10*b* and 10*c* is not caused. Furthermore, the tablet feeder base 27 and the tablet cassette 21 are not essential if the automatic supply of the tablet 10 is not required. The moving elements of the catcher 34 that are driven electrically or hydrodynamically are not necessarily provided separately; alternatively, they may be incorporated in the transitive unit of the holding mechanism or the splitting mechanism, and may be driven by, for example, pushing or rotating a manual handle.

In the embodiment described above, the front blade 41 is fixed at the stationary position P0 during the automatic determination of the relative distance G (refer to prior to the time t0 of FIG. 5(*b*)). Alternatively, the front blade 41 may be moved in conjunction with a change in the relative distance G so that the interspace between the facing blades 41 and 42 is kept to be slightly wider than the relative distance G during the determination of the relative distance G, and that the completion of the automatic determination of the relative distance G is accompanied by the determination of the stationary position P1 for the front blade 41 and the positioning of the front blade 41 at the stationary position P1. Such an operation is more effective in reducing the required time for the adjustment of the first tablet 10 and stabilizing the posture of the first tablet 10 sitting at the splitting position 33.

[Second Embodiment]

An embodiment of the tablet splitting apparatus according to another aspect of the present application will now be described in detail.

Figure 7A:
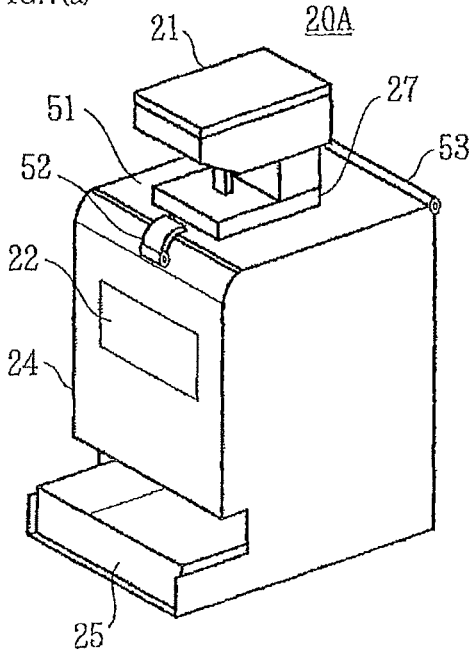
FIG. 7(*a*) is an outline perspective view of a tablet splitting apparatus according to a second embodiment of the invention of the present invention.
Figure 7:
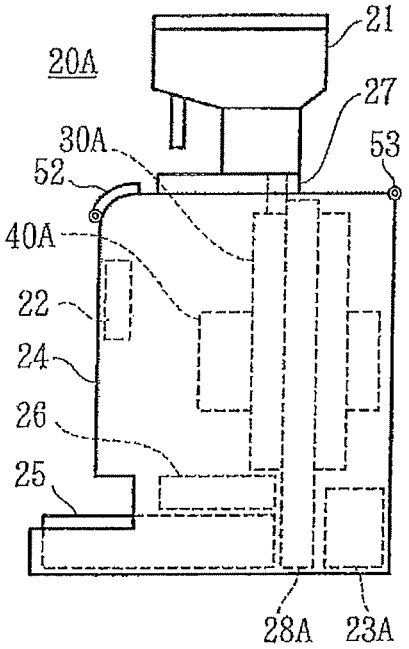
Figure 7C:
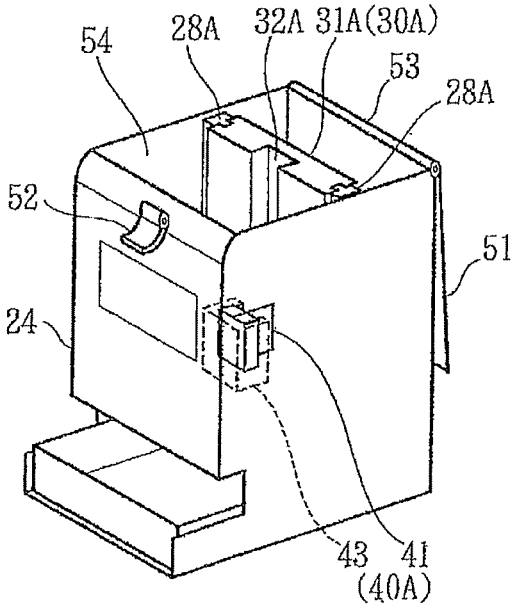
Figure 7D:
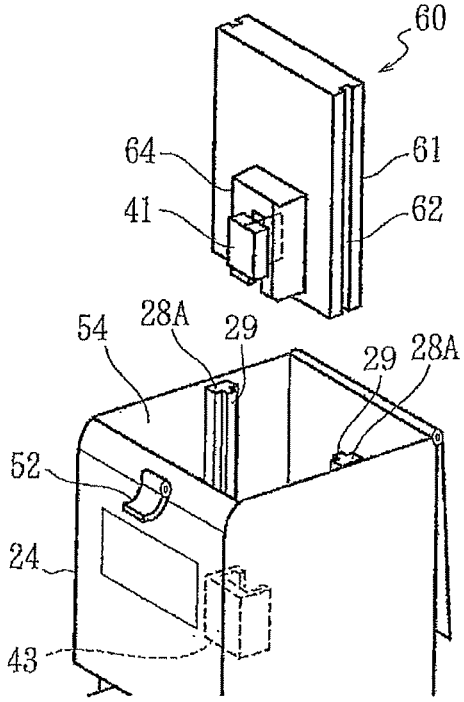

As illustrated in FIGS. 7(*a*) and 7(*b*), a tablet splitting apparatus 20A according the embodiment has a basic structure substantially identical to that of the first embodiment: The tablet splitting apparatus 20A includes a tablet cassette 21, an operating unit 22, a controller 23A, a body 24, a receiver 25, a transitive unit 26, a tablet feeder base 27, a support 28A, a holding mechanism 30A, a splitting mechanism 40A, and a power unit (not shown). The housing (body) 24 accommodates the controller 23A, the transitive unit 26, the support 28A, the holding mechanism 30A, the splitting mechanism 40A, and the power unit. The operating unit 22 and the tablet feeder base 27 are fixed to the body 24 such that an operating screen and a cassette-inserting face reside outside of the housing.

Figure 8A:
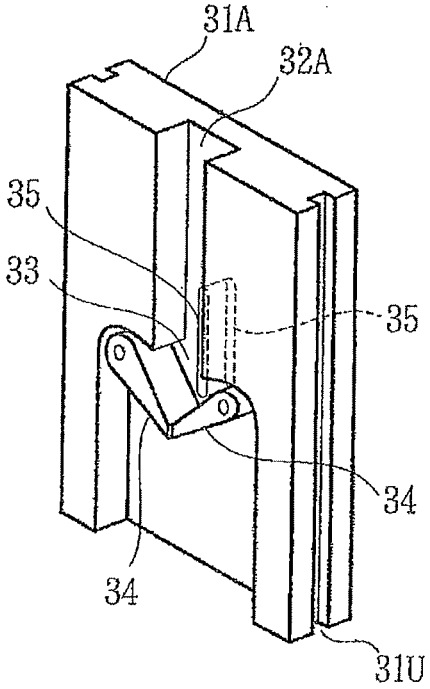
FIG. 8(*a*) is an outline perspective view of a guide and a catcher of the tablet splitting apparatus illustrated in FIG. 7(*a*)
Figure 8:
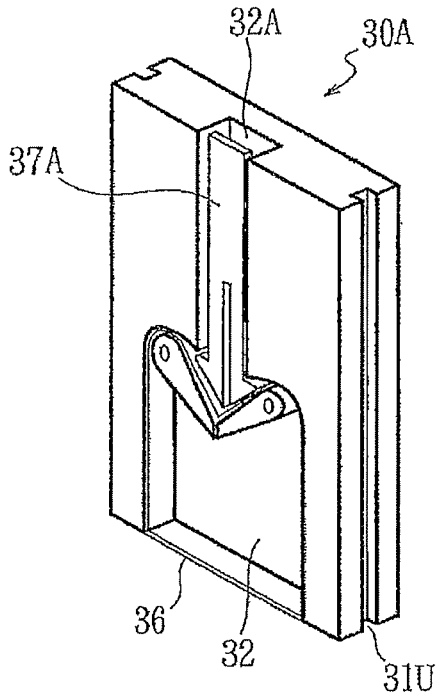
Figure 8:
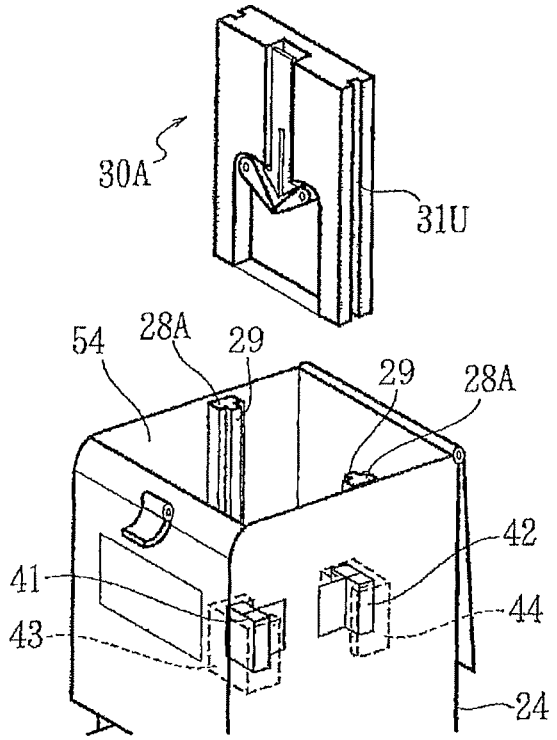
Figure 8D:
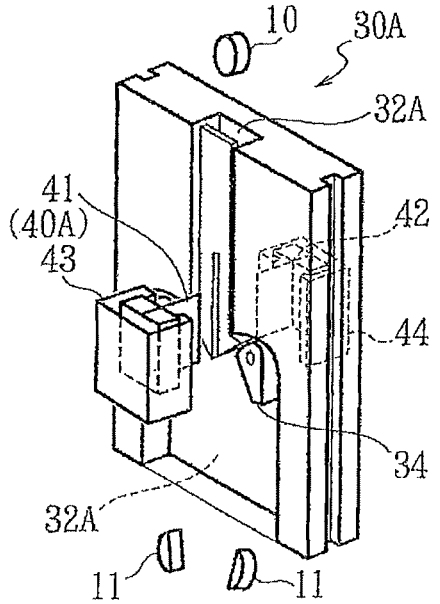

The holding mechanism 30A includes a guide plate 31A (for guiding falling tablets) disposed between the tablet feeder base 27 and the transitive unit 26, a catcher 34, a guide board 37A, and a fixed cover plate 36. The guide plate 31A includes a tablet falling passage 32A (guide passage) and a slit 35 which are formed on the surface of the guide plate 31A. The catcher 34, which opens and closes the guide passage 32A, is disposed within the guide passage 32A and attached to the guide plate 31A (refer to FIGS. 7(*b*) to 7(*d*) and FIG. 8). The guide board 37A is disposed within the upstream site of the guide passage 32A so as to cover the upstream site of the guide passage 32A. The fixed cover plate 36 covers a thickness adjusting mechanism (not shown) and a lower half front surface of the guide plate 31A. FIGS. 8(*b*) to 8(*d*) illustrate the fixed cover plate 36, which is a transparent member fixed to the guide passage 32A, and the perspective view of the guide passage 32.

The splitting mechanism 40A includes facing blades, i.e., a front blade 41 and a back blade 42.

The front blade 41 is supported by a front blade shifter 43 in front of the slit 35 at a splitting position 33, while the back blade 42 is supported by the back blade shifter 44. The front blade 41 moves toward and away from the slit 35 behind the front blade 41 under the control of the controller 23A. The back blade 42 moves toward and away from the tablet 10 at the splitting position 33 through the slit 35 under the control of the controller 23A. Both blades 41 and 42 move toward and away from the slit 35 under the control of the controller 23A.

The tablet splitting apparatus 20A of this embodiment is different from the tablet splitting apparatus 20 of the first embodiment in that the downstream site of the guide passage 32A residing below the splitting position 33 is expanded in width from immediately below the splitting position 33 (refer to FIG. 8(*a*)). The catcher 34, which is the same as that of the first embodiment, is disposed in the wide downstream site immediately below the splitting position 33.

For the basic structure of the tablet splitting apparatus of the embodiment, the same reference numerals are assigned to the same components as those of the first embodiment, and the illustration of some of the components are omitted.

For the tablet splitting apparatus according to the embodiment, a jig for replacing the facing blades 41 and 42 can be used. The jig is, for example, a remover 60 (refer to FIG. 7(*d*) and FIG. 10) or a setter 70 (refer to FIG. 11). The remover 60 or the setter 70, which is separated from the body 24, may be used exclusively to the tablet splitting apparatus of the embodiment or shared among tablet splitting apparatuses of other embodiments.

The body 24 includes a top lid 51, a tablet feeder base 27 fixed on the lid 51, a support 28A vertically fixed in the central portion of the body 24 between the front surface and the back surface of the housing, a transitive unit 26 fixed in front of the lower portion of the support 28A within the housing, and a drawable receiver 25 disposed below the transitive unit 26.

The holding mechanism 30A and the splitting mechanism 40A disposed in the central portion of the body 24 are attached to the support 28A (refer to FIGS. 7(*b*) and 7(*c*)). The holding mechanism 30A has a vertical posture along the support 28A. The splitting mechanism 40A is perpendicular to the holding mechanism 30A and thus has a horizontal posture. The holding mechanism 30A and the splitting mechanism 40A may be supported by a supporting member other than the support 28A.

The top lid 51 is an openable top plate disposed on the top end of the body 24 of the housing. The lid 51 is opened by releasing a lock 52 and backwardly turning the lid 51 around a hinge 53 to expose an opening 54 (refer to FIGS. 7(*c*) and 7(*d*)). The lid 51 is closed during the split of the tablet (FIGS. 7(*a*) and 7(*b*)). The lid 51 is opened, for example, before the replacement of the facing blades 41 and 42. The opening 54 occupies most of the top end surface of the body 24, and the size (i.e., the shape or area) of the opening 54 is sufficiently large so as to allow the guide plate 3 IA of the holding mechanism 30A and the facing blades 41 and 42 of the splitting mechanism 40A, which will be described below, to move therethrough. The opening 54 is sufficiently large so as to allow the guide plate 31A together with the facing blades 41 and 42 to be put into and taken out from the housing of the body 24.

The support 28A consists of two pillars (refer to FIGS. 7(*b*) to 7(*d*)). The two pillars, which vertically extend from the inner bottom surface to the top of the body 24 of the housing, are respectively disposed on the two sides of the housing in parallel to each other such that projections 29 of the pillars inwardly project in the housing and face each other. Opening the lid 51 exposes the upper end of the support 28A residing immediately below the opening 54 (refer to FIGS. 7(*c*) and 7(*d*)). A depression 31U of the guide plate 31A of the holding mechanism 30A, a depression 62 of a jig body 61 of the remover 60, and a depression 72 of a jig body 71 of the setter 70, which are described below, can slide along the projection (slider) 29 to engage the projection 29 or to detach from the projection 29. In other words, the projection 29 functions as a sliding unit (for fixing the guide plate) and as an engaging unit (for fixing the guide plate). The projection 29 is formed from the top end to the bottom end or close to the bottom end of the support 28A. The support 28A having such a projection 29 has an engaging end residing immediately below the opening 54.

The guide plate 31A of the embodiment, which is composed of a relatively thick and vertical plate, has two depressions 31U respectively on its sides, as described above. Engaging the bottom end of the depression 31U with the top end of the projection 29 of the support 28A and sliding the guide plate 31A from the opening 54 into the body 24 (refer to FIG. 8(*c*)) engages the guide plate 31A with the support 28 A, fixing the guide plate 31A at a predetermined position (supporting position) in the body 24 in parallel to the front surface and the rear surface of the body 24 (FIGS. 7(*b*) and 7(*c*)). As described above, the guide plate 31A is slidably engageable with the support 28A and is slidably detachable from the support 28A disposed in the body 24 of the housing. The guide plate 31A thus can be readily engaged with the support 28A in a slidable state by inserting the guide plate 31A from the opening 54 into the body 24 of the housing.

The configuration of the splitting mechanism 40A which is not described in the first embodiment will now be described in detail.

Figure 9A:
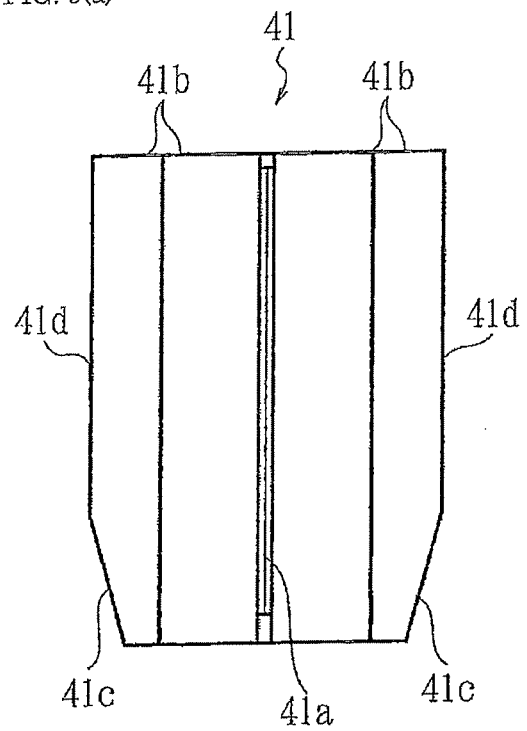
FIG. 9(*a*) is a front view of a front blade of the splitting mechanism illustrated in FIG. 8(*d*)
Figure 9B:
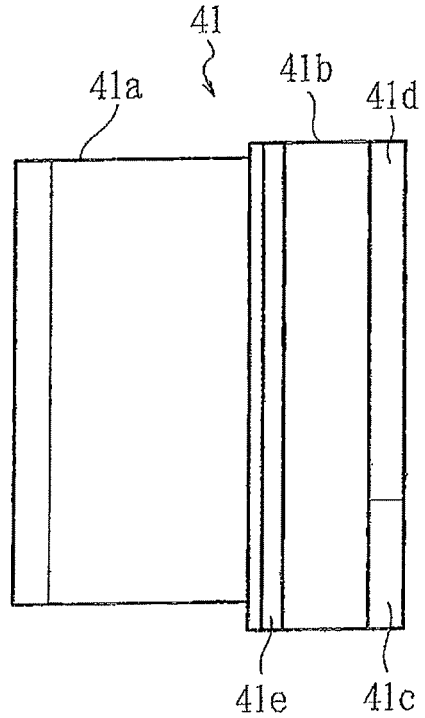
Figure 9:
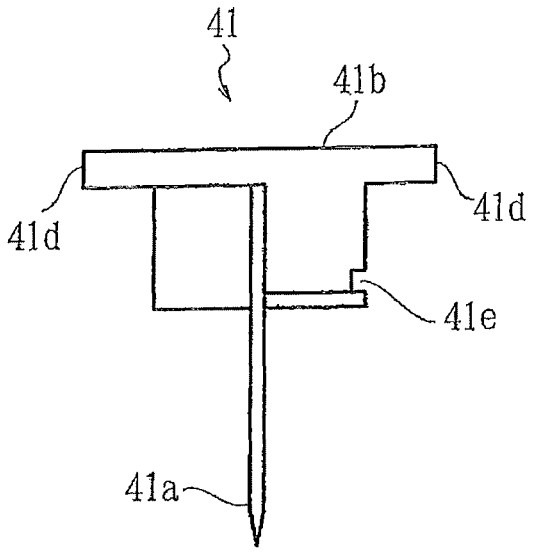
Figure 9D:
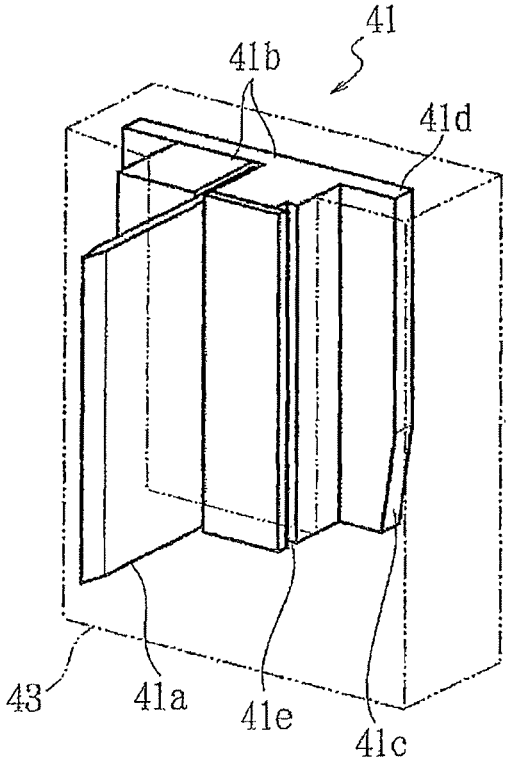
Figure 10A:
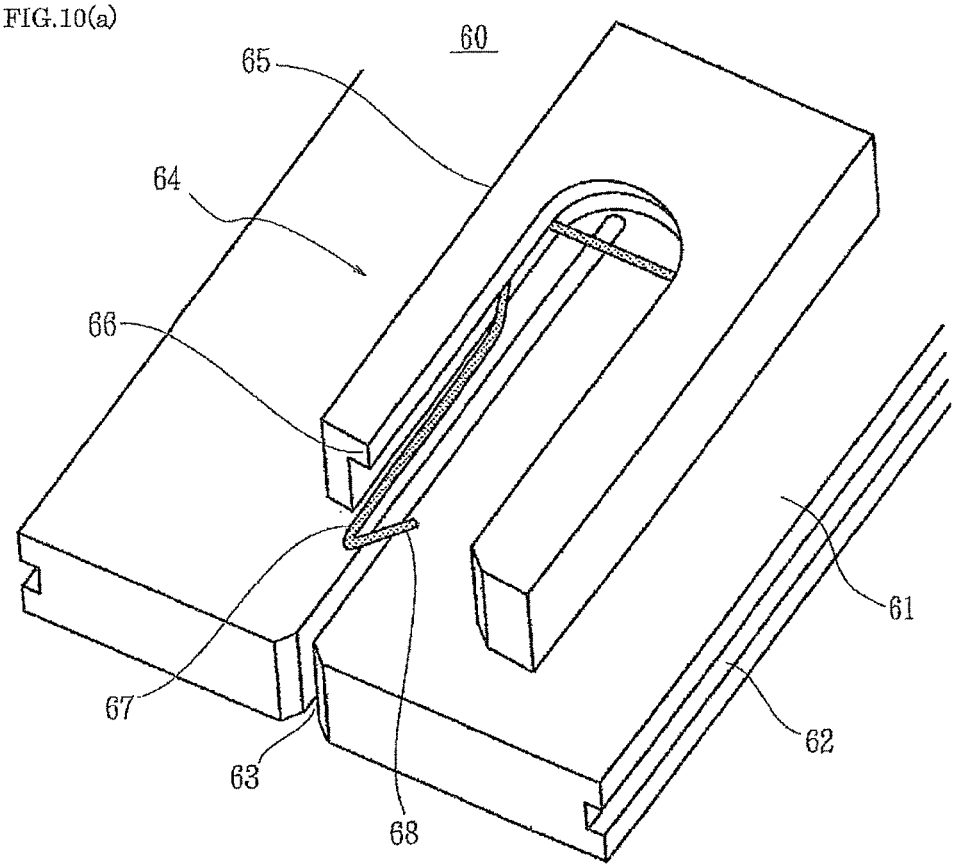
FIG. 10(*a*) is an outline view of a blade holder of the remover (jig for replacing blades) illustrated in FIG. 7(*d*) and surrounding components.
Figure 10B:
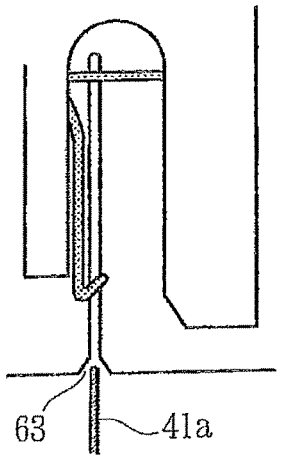
Figure 10C:
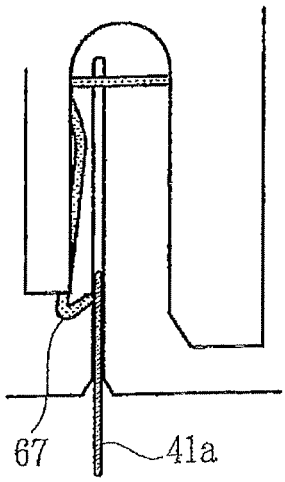
Figure 10D:
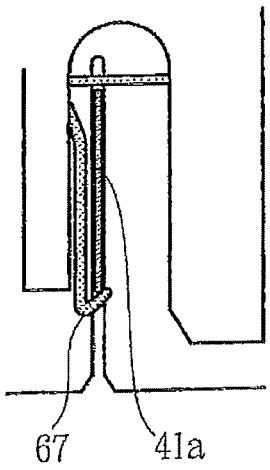
Figure 11A:
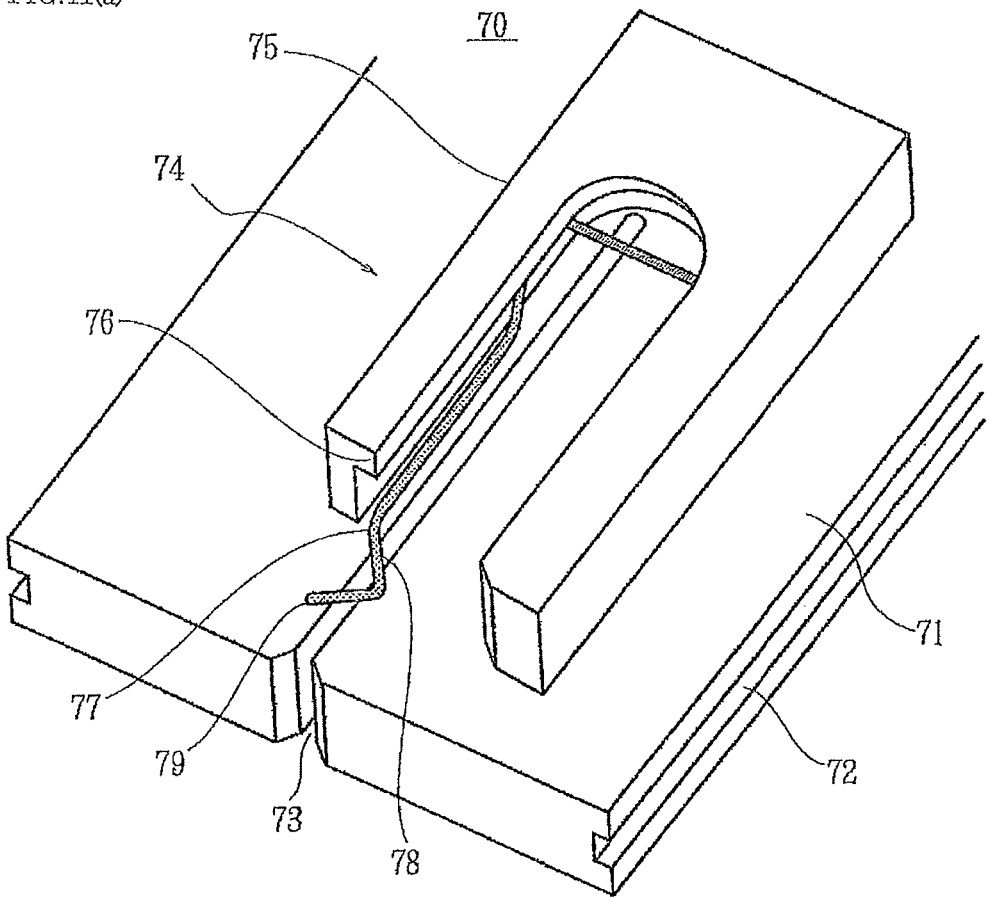
FIG. 11(*a*) is an outline perspective view of a blade holder of a setter (jig) for replacing (attaching) the blade of the tablet splitting apparatus illustrated in FIG. 7(*c*) and the surrounding components.
Figure 11B:
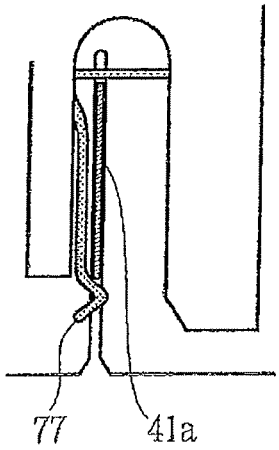
Figure 11C:
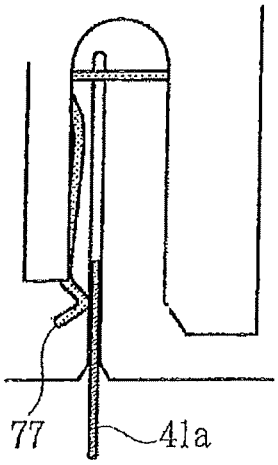
Figure 11D:
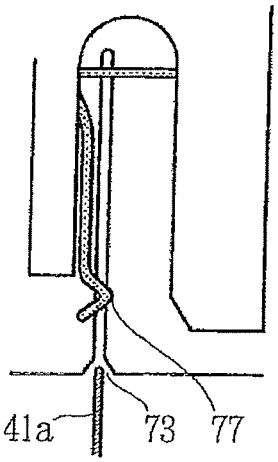

As illustrated in FIG. 9, the front blade 41 of the splitting mechanism 40A has a blade edge 41*a* for cutting into the tablet 10 and blade body 41*b* for mounting the blade edge 41*a* to a front blade shifter 43. The blade body 41*b* includes projections 41*d* vertically extending on the two sides of the blade body 41*b*, the projections 41*d* each including a tapered portion 41*c* at the bottom end thereof. The front blade 41 is fitted at the bottom ends of the projections 41*d* to the top ends of the depressions of the front blade shifter 43 and is vertically slid in the downward direction so as to slidably engage with the front blade shifter 43. In other words, the bottom ends of the projections 41*d* of the front blade 41 and the depressions of the front blade shifter 43 function as slidable units (for attachment) and engaging units (for attachment in a slidable and engageable manner). To remove the front blade 41 from the front blade shifter 43 fixing the front blade 41, the front blade 41 can be vertically and slidably pulled up from the front blade shifter 43 in a fixed state.

The blade body 41*b* of the front blade 41 also includes a depression 41*e* which vertically extends across the portion residing outside of the front blade shifter 43, while the blade 41 is mounted to the front blade shifter 43. The depression 41*e* can be detachably engaged in a slidable manner with a projection 66 of a blade holder 64 of a remover 60 (jig for replacing blades) and with a projection 76 of a blade holder 74 of a setter 70 (jig for replacing blades), which will be described in detail below. Such a structure allows the front blade 41 to be attached to and detached from the remover 60 or the setter 70. In other words, the depression 41*e* functions as a slidable unit (for temporal holding) and as an engaging unit (for temporal holding).

In the following description, repeated description is avoided: The back blade 42 has a structure substantially identical to that of the front blade 41. The back blade 42 thus can be slidably attached to and detached from the back blade shifter 44, the remover 60, or the setter 70.

The sliding direction of the back blade 42 relative to the back blade shifter 44, that of the front blade 41 relative to the front blade shifter 43, and that of the guide plate 31A relative to the support 28A are parallel to one another, and an opening 54 resides above one ends of these three sliding directions. Such a structure allows the front blade 41 and the back blade 42 to be individually or simultaneously installed, or to be installed with the remover 60 or the setter 70 in place of the guide plate 31A, through the opening 54 into the body 24 of the housing, so that the facing blades 41 and 42 can slidably engage the respective blade shifters 43 and 44. Likewise, these components can be detached through the opening 54 to outside of the housing in any combination.

The remover 60 is a jig for removing the facing blades 41 and 42 which are attached to the front blade shifter 43 and the back blade shifter 44, respectively, from the body 24 of the housing (refer to FIG. 10 and FIG. 7(*d*)). The remover 60 includes the jig body 61, which is a plate member having a width equal to that of the guide plate 31A, and a blade holder 64, which is attached to the jig body 61. The blade holder 64 can support the blade. As illustrated in FIG. 10, the jig body 61 includes, on its front side, the blade holder 64 for detaching the front blade 41. The jig body 61 also includes, on its rear side, another blade holder (not shown) for detaching the back blade 42.

The two sides of the jig body 61 are provided with respective depressions 62 which are substantially identical to the depressions 31U of the guide plate 31A described above. The jig body 61 having such depressions 62 can be detachably engaged with the support 28A in a slidable manner, after the detachment of the guide plate 31A to outside of the housing.

The jig body 61 also has a notch 63. The notch 63 prevents the jig body 61, the blade edge 41*a* of the front blade 41, and the blade edge of the back blade 42 from abutting each other during sliding the jig body 61 into the body 24 through the opening 54 to engage the jig body 61 with the support 28A after the detachment of the guide plate 31A. The position of the notch 63 is determined so as to prevent such abutting. The blade holder 64 on the front surface of the jig body 61 also includes a U-shaped fixer 65 and a thin elastic wire 67 attached to the interior of the fixer 65. The fixer 65 is positioned such that the blade body 41*b* of the front blade 41 attached to the front blade shifter 43 is fit into the fixer 65 upon the engagement of the jig body 61 with the support 28A. Likewise, the blade holder 64 on the rear surface of the jig body 61 also includes the fixer and the elastic wire.

The fixer 65 has a projection 66. The projection 66 slidably engages with the depression 41*e* of the blade body 41*b* of the front blade 41, upon the engagement of the jig body 61 with the support 28A.

The elastic wire 67 has a top end fixed to the fixer 65 and a movable bottom end 68. The movable end 68 is bent back at an acute angle so as to obliquely extend across the notch 63. The remover 60 having such a structure can hold the front blade 41 attached to the front blade shifter 43 with the blade holder 64, upon the engagement of the remover 60 with the support 28A, and can remove the front blade 41 from the front blade shifter 43, upon the detachment of the remover 60 carrying the front blade 41 from the support 28A.

In specific, to remove the front blade 41, the guide plate 31A is detached from the support 28A. The remover 60 is then slid into the support 28A without the guide plate 31A. This causes a relative displacement of the remover 60 and the front blade 41, directing the blade edge 41*a* into the notch 63 (refer to FIG. 10(*b*)). The blade edge 41*a* abuts the movable end 68, temporarily deforming the elastic wire 67 to cause deviation of the movable end 68 from the normal position (refer to FIG. 10(*c*)). The blade edge 41*a* is further plunged into the notch 63 so as to pass over the movable end 68, restoring the elastic wire 67 to the original shape. This allows the movable end 68 to trap the blade edge 41*a*, inhibiting disconnection of the blade edge 41*a* (refer to FIG. 10(*d*)). Upon the detachment of the remover 60 from the support 28A, the front blade 41 held by the blade holder 64 is slid to remove from the front blade shifter 43. In other words, the remover 60 is detached together with the front blade 41 (refer to FIG. 7(*d*)). The same is applied to the back blade 42.

The setter 70 is a jig for attaching new facing blades 41 and 42 to the front blade shifter 43 and the back blade shifter 44 in the body 24 of the housing, respectively. As illustrated in FIG. 11, the setter 70 includes the jig body 71, which is a plate member having a width equal to that of the guide plate 31A, and a blade holder 74, which is attached to the jig body 71. The blade holder 74 can support the blade. As illustrated in FIG. 11, the jig body 71 includes, on its front side, the blade holder 74 for attaching the front blade 41. The jig body 71 also includes, at its rear side, another blade holder (not shown) for attaching the back blade 42. The two sides of the jig body 71 are provided with respective depressions 72 which are substantially identical to the depressions 31U of the guide plate 31A described above. The jig body 71 having such depression 72 can be detachably engaged with the support 28A in a slidable manner, in place of the guide plate 31A.

The jig body 71 also has a notch 73. The notch 73 accommodates the blade edge 41*a* of the front blade 41 preliminarily attached to the front blade shifter 43. The position of the notch 73 is determined so as to facilitate the separation of the blade edge 41*a* from the notch 73 upon the detachment of the blade holder 74 from the support 28A after the attachment of the front blade 41 to the front blade shifter 43. The blade holder 74 on the front surface of the jig body 71 also includes a U-shaped fixer 75 and a thin elastic wire 77 attached to the interior of the fixer 75. The fixer 75 is positioned such that the blade body 41*b* of the front blade 41 is fit into the fixer 75 upon the hold of the front blade 41. Likewise, the blade holder 74 on the rear surface of the jig body 71 also includes the fixer and the elastic wire.

The jig body 71 and the fixer 75 of the setter 70 may be the same as the jig body 61 and the fixer 65 of the remover 60, respectively, and the elastic wire 77 may be composed of the same material as that of the elastic wire 67. The elastic wire 77, however, is bent into a different shape from that of the elastic wire 67.

The fixer 75 also has a projection 76 substantially identical to the projection 66. The projection 76 slidably engages with the depression 41*e* of the blade body 41*b* of the front blade 41, upon the hold of the front blade 41. The projection 76 is slid out to remove from the depression 41*e* of the blade body 41*b* of the front blade 41 before the attachment of the front blade 41 to the front blade shifter 43.

The elastic wire 77 has a top end fixed to the fixer 75 and a movable bottom end 78. The movable end 78 is bent at a blunt angle so as to obliquely extend across the notch 73. In other words, the movable end 78 obliquely extends across the notch 73 in a right downward direction, for example, which is opposite to the direction of the movable bottom end 68. The elastic wire 77 having such a structure hooks the blade edge 41*a* with a weak force compared to, for example, the movable end 68. This structure allows for the following operation: The jig body 71 carrying the front blade 41 held by the blade holder 74 is engaged with the support 28A to engageably attach the front blade 41 to the front blade shifter 43. The jig body 71 is then detached from the support 28A, so that the front blade 41 is kept attached to the front blade shifter 43 and is detached from the blade holder 74.

In specific, the elastic wire 77 has an utmost end 79 in addition to the movable end 78 described above. The utmost end 79 is bent in an opposite direction to that of the movable end 78, extending across the notch 73 in a left downward direction. For the preliminary attachment of the front blade 41 to the blade holder 74, the blade edge 41*a* of the front blade 41 is put close to the notch 73 (refer to FIG. 11(*d*)) and is slid into the notch 73 (refer to FIG. 11(*c*)). This facilitates the attachment of the front blade 41 to the blade holder 74 (refer to FIG. 11(*b*)). The setter 70 carrying the front blade held by the blade holder 74 (refer to FIG. 11(*b*)) is slid into the support 28A after the detachment of the guide plate 31A, so that the projection 41*d* of the blade body 41*b* of the front blade 41 is slid to engage with the front blade shifter 43. The front blade 41 slidably engaging the front blade shifter 43 is firmly attached to the front blade shifter 43 by frictional force between the sliding parts.

During the detachment, the setter 70 is relatively displaced in a direction away from the front blade 41 supported by the front blade shifter 43 with the frictional force. At this time, the movable end 78 is urged by the blade edge 41*a* attached to the front blade shifter 43, temporarily deforming the elastic wire 77 to cause deviation of the movable end 78 from the normal position (refer to FIG. 11(*c*)). The blade edge 41*a* is then slid out from the notch 73, allowing the movable end 78 and the utmost end 79 to pass over the blade edge 41*a*. This allows the elastic wire 77 to be restored to the original shape (refer to FIG. 11(*d*)). After the detachment of the setter 70 from the support 28A, the front blade 41 resides within the body 24 and remains attached to the front blade shifter 43. The same is applied to the back blade 42.

The controller 23A controls the operation of the electric motors for the tablet feeder base 27, the holding mechanism 30A, and the splitting mechanism 40A and determines the position of the guide board 37A on the basis of the thickness of the tablet 10, similarly as the controller 23 of the first embodiment.

The mode of the use and operation of the tablet splitting apparatus according to the embodiment will now be described with reference to the drawings.

Since the operation for splitting tablets of the tablet splitting apparatus according to the embodiment is substantially identical to that of the tablet splitting apparatus 20 according to the first embodiment, the repeated description thereof is omitted herein.

The subsequent split of tablet 10 by the tablet splitting apparatus 20A according to the embodiment gradually wears the facing blades 41 and 42 in the edges and is eventually subjected to the need for the replacement of the facing blades 41 and 42.

For the replacement of the facing blades 41 and 42, the holding mechanism 30A is detached (refer to FIG. 7(*c*) and FIG. 8(*c*)), and the remover 60 is slid into the support 28A in place of the holding mechanism 30A and is then slid out therefrom to remove the worn facing blades 41 and 42 from the splitting mechanism 40A (refer to FIGS. 10(*b*) to (*d*), FIG. 7(*d*)). The setter 70 is then slid into and out of the support 28A so that new facing blades 41 and 42 are attached to the splitting mechanism 40A (refer to FIGS. 11(*b*) to 11(*d*)). The holding mechanism 30A is slid into the support 28A again to complete the replacement of the facing blades 41 and 42 (refer to FIGS. 7(*a*) and 7(*b*)). The worn facing blades 41 and 42 can be rapidly and surely replaced with new blades 41 and 42 through such a simple operation.

In specific, for the replacement of the blades, the operator operates the operating unit 22 to halt the automatic operation such as the injection of the tablets from the tablet cassette 21 into the body 24 and the split of the tablets by the splitting mechanism 40A. The operator then manually detaches the tablet cassette 21 from the tablet feeder base 27 and releases a lock 52 to open a lid 51 to expose an opening 54 of the body 24 (refer to FIG. 7(*c*)). The operator manually pulls the top end of the guide plate 31A through the opening 54 to withdraw the holding mechanism 30A (refer to FIG. 8(*c*)). This completes preparation for the replacement of the facing blades 41 and 42.

The operator then manually inserts the jig body 61 of the empty remover 60 into the support 28A after the detachment of the guide plate 31A. This allows the facing blades 41 and 42 to be held by the blade holders 64 of the remover 60 (refer to FIGS. 10(*b*) to 10(*d*)). The operator then withdraws the remover 60 through the opening 54, so that the facing blades 41 and 42 are withdrawn together with the remover 60 from the body 24 (refer to FIG. 7(*d*)). The worn facing blades 41 and 42 attached to the remover 60 can be safely handed over to a recycling facility and can be subjected to an appropriate process, for example, recycling or disposal.

The operator then manually inserts the jig body 71 of the setter 70 which holds new facing blades 41 and 42 into the support 28A after the detachment of the jig body 61, so that the facing blades 41 and 42 held by the blade holders 74 are attached to the front blade shifter 43 and the back blade shifter 44, respectively (refer to FIG. 11(*b*)). The operator then withdraws the setter 70 through the opening 54, so that the facing blades 41 and 42 are removed from the blade holders 74 (refer to FIGS. 11(*c*) to 11(*d*)) and stay within the body 24 while being attached to the front blade shifter 43 and the back blade shifter 44, respectively. This allows only the setter 70 to be withdrawn from the body 24.

After the replacement with the new facing blades 41 and 42, the operator mounts the holding mechanism 30A to the support 28A (refer to FIG. 8(*c*)) such that the holding mechanism 30A is disposed at a predetermined position in the body 24 (refer to FIG. 8(*d*) and FIG. 7(*c*)). The operator then closes the lid 51 and the lock 52, and mounts the tablet cassette 21 on the tablet feeder base 27 (refer to FIG. 7(*a*)). This completes the operation for replacing the blades, allowing the tablet splitting operation to restart.

[Others]

In the second embodiment, the facing blades 41 and 42 are moved during the replacement; however, during the replacement, the interspace between the facing blades 41 and 42 may be narrowed by, for example, the instruction from the operating unit 22. This makes the jigs 60 and 70 for replacing blades thinner, the splitting mechanism 40A denser, and the body 24 compacter.

In the second embodiment, the splitting mechanism 40A splits the tablet 10 by moving the facing blade towards and away from each other; however, the splitting mechanism 40A may include a single blade if splitting of the tablet 10 is available with the blade.

Furthermore, in the second embodiment, the tablet 10 is divided into pieces having equal dimensions; however, the tablet 10 may be divided into pieces having different dimensions.

The operating unit 22 of the second embodiment is not essential: alternatively, any sequential operation may be started in response to the injection of the tablet 10 into the top end of the guide passage. The receiver 25 and the transitive unit 26 are not essential if any inconvenience for the discharge of the split pieces 11, 11 is not caused. Furthermore, the tablet feeder base 27 and the tablet cassette 21 are not essential if the automatic supply of the tablet 10 is not required. The moving elements of the catcher 34 which are driven electrically or hydrodynamically are not necessarily provided separately; alternatively, they may be incorporated in the transitive unit of the holding mechanism or the splitting mechanism, and may be driven by, for example, pushing or rotating a manual handle.

The configuration and technology on replacement of the blades described in the second embodiment can be widely applied not only to the facing blades but also to a common tablet splitting apparatus including a splitting mechanism having a single blade or rotational blade(s).

[Third Embodiment]

An embodiment of a removing mechanism (for removing dust from the tablet split pieces) of a tablet splitting apparatus 20B according to another aspect of the present invention will now be described in specific with reference to the drawings.

For simplification of the description, only component are illustrated which are essential for or relevant to the description of the present invention, while the illustration of the other components are omitted; fasteners such as bolts, connections such as hinges, a driving sources such as electric motors, transmissions such as timing belts, and detailed description of an electric circuit of a motor driver and an electronic circuit of a controller.

Figure 12A:
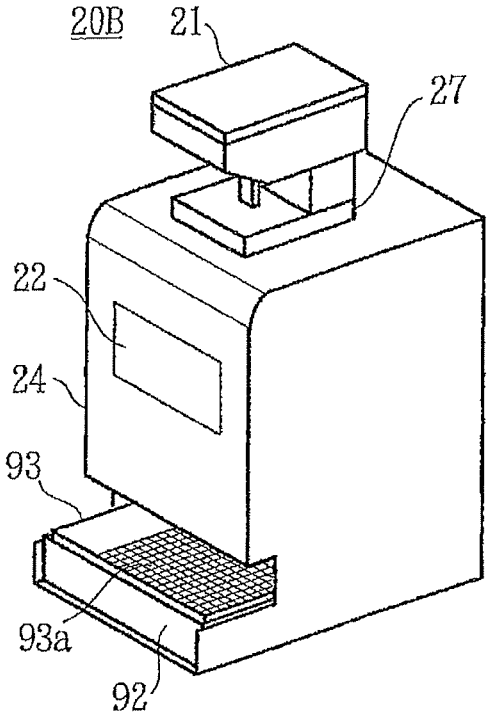
FIG. 12(*a*) is an outline perspective view of a tablet splitting apparatus according to a third embodiment of the invention of the present application.
Figure 12:
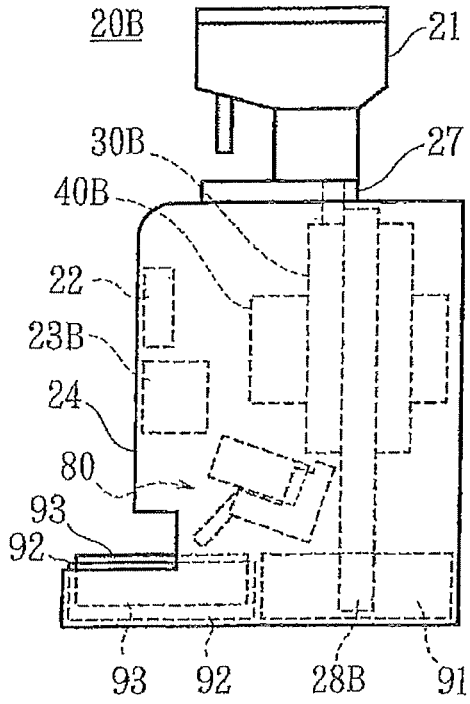
Figure 12C:
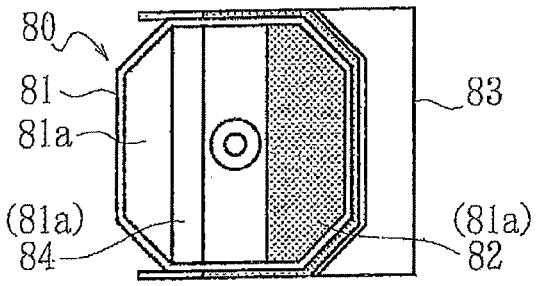
Figure 12D:
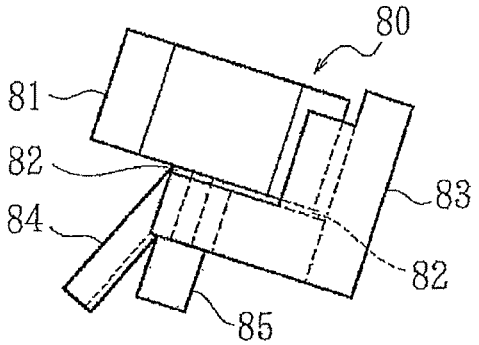
Figure 12E:
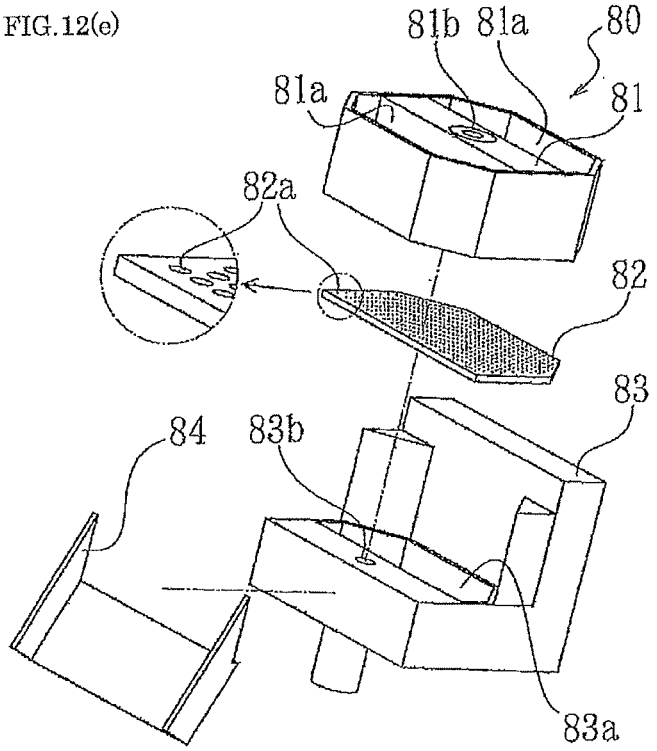

As illustrated in FIG. 12, the tablet splitting apparatus 20B according to the embodiment has a basic structure substantially identical to that of the tablet splitting apparatus according to the first embodiment; the tablet splitting apparatus 20B includes a tablet cassette 21, an operating unit 22, a controller 23B, a body 24, a tablet feeder base 27, a support 28B, a holding mechanism 30B, and a splitting mechanism 40B, and a power unit (not shown). The body or housing 24 accommodates the controller 23B, support 28B, holding mechanism 30B, splitting mechanism 40B, transitive unit 80, and power unit.

Similarly to the first embodiment, the tablet feeder base 27 and the tablet cassette 21 discharge one tablet at a time from the tablet cassette 21 into the top end of the holding mechanism 30B, under the control of the controller 23B. The holding mechanism 30B includes a catcher for temporarily holding the falling tablet at a splitting position. The splitting mechanism 40B splits the tablet held at the splitting position into two split pieces 11, 11, with a single blade, facing blades, or rotational blade(s).

The holding mechanism 30B, the splitting mechanism 40B, and a transitive unit 80 are attached to the support 28B or any other supporting member such that they are disposed in the middle of the body 24 of the housing.

For the basic structure of the tablet splitting apparatus of the embodiment, the same reference numerals are assigned to the same components as those of the first embodiment, and the illustration of some of the components are omitted.

The tablet splitting apparatus 20B of the embodiment is different from the tablet splitting apparatus 20 of the first embodiment in that it includes a separating mechanism 80 which also functions as a transitive unit (transitive section) 80, a first dust receiver 91, a second dust receiver 92, and a split piece receiver 93. The separating mechanism 80 is incorporated in the transitive unit, which will be described in detail below.

The first dust receiver 91 is attached to the bottom of the body 24 so as to be drawable through a rear opening of the body 24. The split piece receiver 93 is disposed above the second dust receiver 92 such that the lower portion of the split piece receiver 93 resides within the top opening of the second dust receiver 92, forming a two-tiered structure. The second dust receiver 92 and the split piece receiver 93 are attached to the bottom of the body 24 so as to be drawable from the front opening of the body 24.

The body 24 includes the separating mechanism 80, which is fixed to the front bottom of the support within the housing and functions also as a transitive unit, the split piece receiver 93 and the second dust receiver 92, which are disposed below and in front of the separating mechanism 80, and the first dust receiver 91, which is disposed adjacent to the rear bottom of the separating mechanism 80.

Similarly to the first embodiment, the tablet feeder base 27 and the tablet cassette 21 discharge one tablet at a time from the tablet cassette 21 into the top end of the holding mechanism 30B, under the control of the controller 23B. The holding mechanism 30B includes a catcher for temporarily holding the falling tablet at a splitting position. The splitting mechanism 40B splits the tablet held in the splitting position into two split pieces 11, 11, with a single blade, facing blades, or rotational blade(s).

The separating mechanism 80 first functions as a transitive unit for receiving the split piece 11 falling from the bottom end of the holding mechanism 30B, and transfers the split piece 11 into the split piece receiver 93. Upon the transfer of the split piece 11, the separating mechanism 80 also removes the dust 12 generated by the split of the tablet, from the split piece 11, and feeds the dust 12 into the first dust receiver 91. To achieve such a function, the separating mechanism 80 includes a switching member 81 (for switching the tablet falling paths), a partitioning plate 82, a supporting base (inclined support) 83, a chute 84, and a rotational driving mechanism 85 (refer to FIGS. 12(*b*) to 12(*e*)).

The switching member 81 is a polygonal plate the overall shape of which is approximately a thick rotating plate. The switching member 81 has a bore 81*b* fitting to a rotary shaft in the middle thereof and two split piece falling paths 81*a* (hereinafter referred to as split piece paths) separated by the bore 81*b*. If the switching member 81 has a horizontal posture, the split piece paths 81*a* and the bore 81*b* vertically extend through the switching member 81, and they each have an open top end and an open bottom end and are surrounded by the inner side surfaces of the switching member 81.

The split piece path 81*a* is sufficiently large so as to allow the split pieces 11 to pass therethrough. Both the open top end surface and the open bottom end of the split piece path 81*a* is smaller than the top surface of the partitioning plate 82 which can cover the bottom surface of the split piece path 81*a*. The two split piece paths 81*a* are positioned such that these positions are mutually switched every time the switching member 81 rotates 180°.

In specific, the switching member can rotate between a plurality of rotational positions (rotational phases) to allow one of the split piece paths to reside above the partitioning plate.

The partitioning plate 82 is a flat plate having a large number of pores 82*a* for separating the dust, the pores being formed by punching, for example. The pores 82*a* are fine through holes vertically extending through the flat partitioning plate 82 in a horizontal state. The pore 82*a* allows the dust 12 smaller than the split piece 11 to pass therethrough, while it prevents the split piece 11 larger than the dust 12 from passing therethrough.

The chute 84 is a guiding member, which may be a slide or a gutter, and is disposed slantwise so that the split piece 11 slides down the chute 84 into the split piece receiver 93 disposed downstream of the chute 84.

The rotational driving mechanism 85 includes a motor and a reduction gear which drive the rotary shaft under the control of the controller 23B. The tip of the rotary shaft is fit into the split piece path 81*a* of the switching member 81 so that the switching member 81 can rotate about the shaft.

The supporting base 83 supports the switching member 81, the partitioning plate 82, and the chute 84, which are described above, and is fixed to the interior of the body 24 while inclining by several tens of degrees such that the lower portion thereof is directed forward and the upper portion thereof is directed backward.

The supporting base 83 further includes a dust falling path 83*a* (hereinafter referred to as a dust path) formed at the rear side thereof and a bore 83*b* fitting to the rotary shaft, at its front side. The dust path 83*a* has a cross-section substantially equal to or larger than that of the split piece path 81*a*. The bore 83*b* functions also as a bearing hole rotatably supporting the rotary shaft extending therethrough. The rotary shaft is disposed so as to extend from the rotational driving mechanism 85 to the switching member 81. Since the dust path 83*a* and the bore 83*b* are vertical through holes extending through the supporting base 83 in a horizontal state, they are backwardly inclined at the same angle as that of the supporting base 83. The rotary shaft extending through the bore 83*b* is perpendicular to a front extension of the partitioning plate 82.

The partitioning plate 82 is attached to the supporting base 83 so as to cover the top end surface of the dust path 83*a*. The dust path 83*a* directs the dust 12 passing through the pores 82*a* of the partitioning plate 82 to a downward direction. The switching member 81 is coupled to the top end of the rotary shaft extending through the bore 83*b*. When the switching member 81 is rotated, the rear portion of the switching member 81 is disposed above the partitioning plate 82. The switching member 81, split piece paths 81*a*, partitioning plate 82, and pores 82*a* are all inclined at the same angle as that of the supporting base 83 such that the lower portions thereof are directed forward and the upper portions thereof are directed backward.

The front end of the supporting base 83 is coupled to the top end of the chute 84. The chute 84 is downwardly inclined at a relatively steep angle. On the other hand, the front portion of the supporting base 83 extends slightly beyond the bore 83*b*. The front end of the supporting base 83 resides slightly in front of the bore 83*b*. In conjunction with the rotation of the switching member 81 about the rotary shaft, the two split piece paths 81*a* of the switching member 81 alternately reside at a higher front (releasing) position the altitude of which corresponds to the inclined angle of the supporting base 83. The split piece path 81*a* residing at the higher front position is not contact with the partitioning plate 82 and the supporting base 83, so that the bottom end surface of the split piece path 81*a* is opened above the chute 84.

In conjunction with the rotation of the switching member 81 about the rotary shaft, the two split piece paths 81*a* alternately reside at a lower rear position the altitude of which corresponds to the inclined angle of the supporting base 83. The lower end surface of the split piece path 81*a* residing above the partitioning plate 82 is covered by the partitioning plate 82.

The first dust receiver 91 and the second dust receiver 92 are each a dish-container or an open-top box container with a rigid bottom. The first dust receiver 91 is slid into the body 24 so as to reside below the dust path 83*a* of the supporting base 83. The dust 12 falling through the dust path 83*a* is received into the first dust receiver 91 through the open top thereof.

The second dust receiver 92 is an outer container accommodating the detachable split piece receiver 93. The split piece receiver 93 is accommodated in the second dust receiver 92 such that the bottom surface of the split piece receiver 93 resides at a slightly higher position than the position of the inner bottom surface of the second dust receiver 92. In other words, the bottom surface of the split piece receiver 93 and the inner bottom surface of the second dust receiver 92 define a space for accumulating the dust 12.

The split piece receiver 93 is a dish-container or an open-top box container with a screen bottom 93*a*.

The screen bottom 93*a* is a sufficiently fine mesh so as to prevent the split piece 11 from passing therethrough and to allow the dust 12, which is smaller than the split piece 11, to pass therethrough. The split piece receiver 93 accommodated in the second dust receiver 92 is slid into the body 24 so as to reside downstream of the chute 84. In this state, the split piece 11 sliding down the chute 84 is received and accumulated within the split piece receiver 93 through the open top of the receiver 93. Some of the dust 12 which falls together with the split pieces 11 into the split piece receiver 93 and also passes through the screen bottom 93*a* is received by the second dust receiver 92.

The controller 23B of the embodiment is substantially the same as that of the first embodiment, which controls the electric motors of the tablet feeder base 27, the holding mechanism 30B, the splitting mechanism 40B, and the separating mechanism 80 to cooperate with each other to achieve continuous supply and split of the tablets in addition to precise separation of the dust from the split pieces.

The mode of the use and operation of the tablet splitting apparatus 20B including the separating mechanism 80 according to the embodiment will now be described with reference to the drawings.

Prior to the split of the tablets, the tablet cassette 21 accommodating a large number of the tablets 10 to be split is attached to the tablet feeder base 27, the first dust receiver 91 is slid into the body 24 from the rear side of the body 24, and the second dust receiver 92 accommodating the split piece receiver 93 is slid into the body 24 from the front side of the body 24 (refer to FIGS. 12(*a*) and 12(*b*)). The tablet splitting apparatus 20B is then activated by, for example, power supply to start the splitting process in response to the instruction from the operating unit 22. This activates the driving motor of the tablet feeder base 27 to discharge one tablet from the tablet cassette 21 activated thereby. The discharged tablet is injected into the body 24, is temporarily held at the splitting position by the holding mechanism 30B, and is split into two split pieces 11, 11 by the splitting mechanism 40B.

Figure 13A:
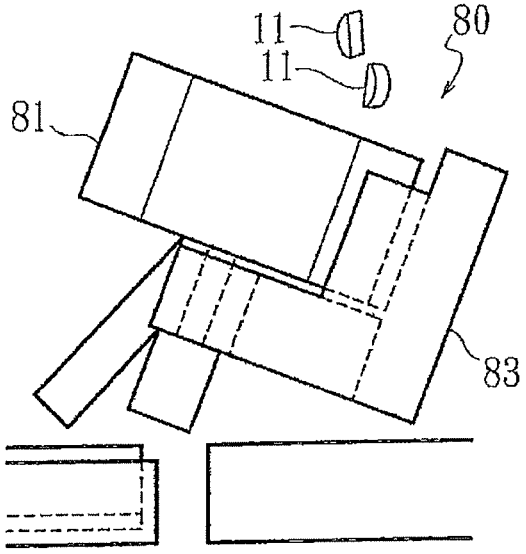
FIG. 13(*a*) is a right side view of the dust separating mechanism and a receiver for illustrating the operation of the dust separating mechanism in chorological order.
Figure 13B:
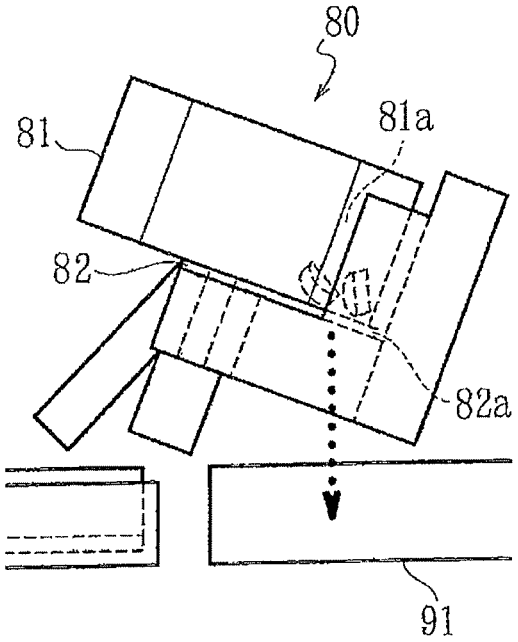
Figure 13:
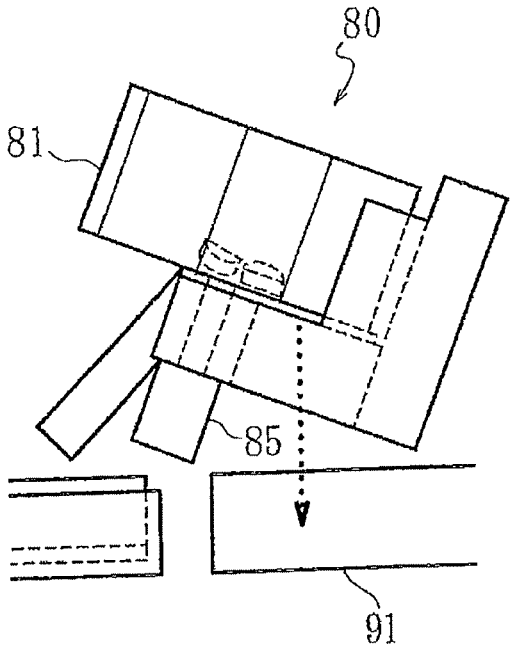
Figure 13D:
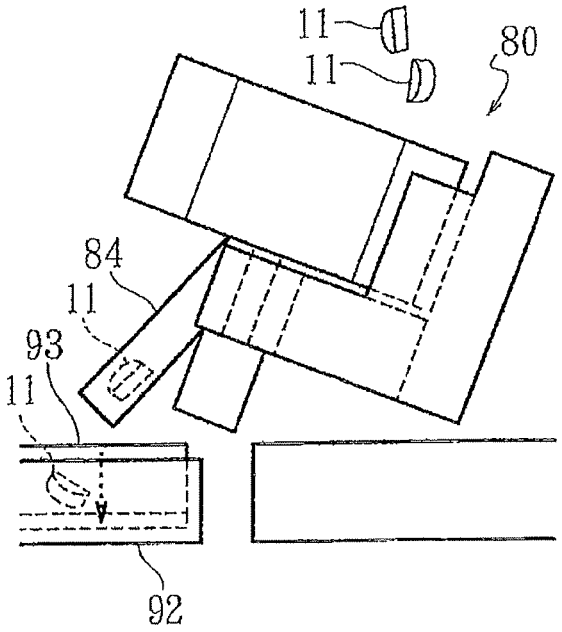

These split pieces 11 are released from the splitting position and are directed toward the separating mechanism 80 (refer to FIG. 13(*a*)). The split pieces 11 fall into one of the split piece paths 81*a* disposed above the partitioning plate 82 (refer to FIG. 13(*b*)). The split pieces 11 passing through the split piece path 81*a* collide with the partitioning plate 82 and are blocked thereon. Most of the fine dust 12 which falls together with the split pieces 11 and which is scattered from the split pieces 11 upon the collision with the partitioning plate 82 passes through the pores 82*a* to be accumulated in the first dust receiver 91 (refer to the dotted arrow in FIG. 13(*b*)).

In conjunction with the rotation of the switching member 81 about the rotary shaft, the split piece path 81*a* disposed at the rear position above the partitioning plate 82 moves toward the front position in an arc (refer to FIG. 13(*c*)). This causes the split pieces 11 to frictionally move along the inclined top surface of the partitioning plate 82 in an upward direction, so that the dust 12 adhering to the split pieces 11 is sifted by the partitioning plate 82. Furthermore, the dust 12 remaining between the pores 82*a* on the partitioning plate is moved while being squeezed or crushed by the bottom side inner surface of the switching member 81 to fall through the pores 82*a* into the first dust receiver 91 (refer to the dotted arrow in FIG. 13(*c*)).

After the split piece path 81*a* accommodating the split pieces 11 is moved to a position in front of the front end of the supporting base 83 (refer to FIG. 13(*d*)), the bottom end surface of the split piece path 81*a* is separated from the partitioning plate 82 and the supporting base 83 to open. The split pieces 11 accommodated in the split piece path 81*a* fall through the open bottom end and slide down the chute 84 into the split piece receiver 93. The split piece 11 received in the split piece receiver 93 remains above the screen bottom 93*a* and is accommodated in the split piece 11 because the split piece 11 is larger than a mesh of the screen bottom 93*a* in size. The dust 12 which is separated from the split pieces 11 sliding down the chute 84 or dropping into the split piece receiver 93 falls through the screen bottom 93*a* and is accommodated in the second dust receiver 92 residing below the split piece receiver 93 (refer to the dotted arrow in FIG. 13(*c*)).

As described above, the split piece 11 falling from the splitting position through the separating mechanism 80 is accumulated into the split piece receiver 93. The dust 12 is separated from the split piece 11 at the separating mechanism 80 and also at the split piece receiver 93 to be accumulated in the first dust receiver 91 and the second dust receiver 92, respectively. Most of the dust 12 thus can be accumulated separately from the split pieces.

In synchronization with the movement of the filled split piece path 81*a* accommodating the split pieces 11 toward the front position, the empty split piece path 81*a* moves toward the rear position and sits on the rear position in place of the filled split piece path 81*a*. The separating mechanism having such a configuration can be rapidly ready to receive the subsequent split pieces 11 (refer to FIG. 13(*d*)), leading to an efficient short-cycle split of tablets.

Figure 14A:
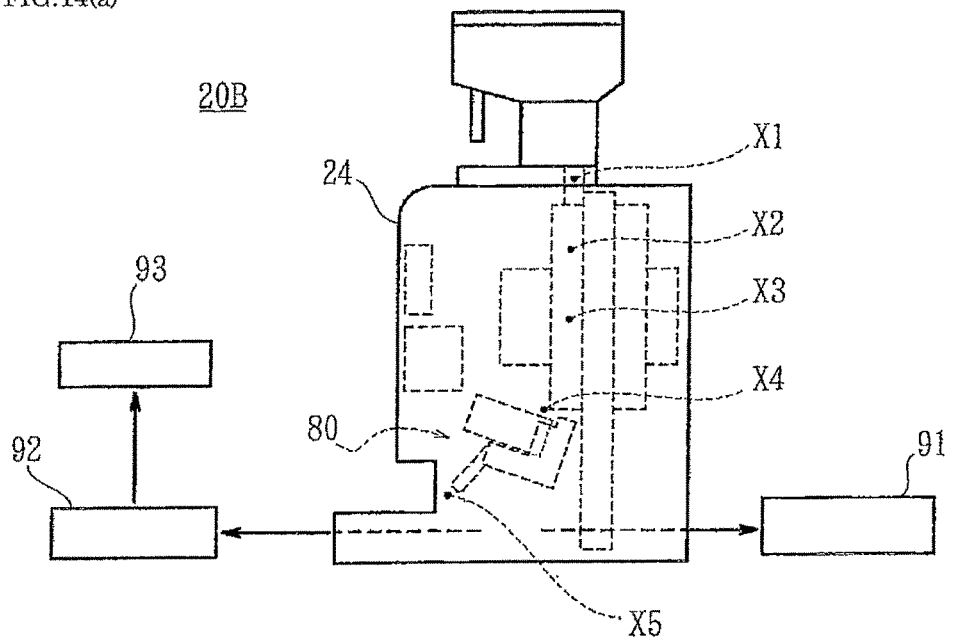
FIG. 14(*a*) is a right side view of the tablet splitting apparatus for illustrating the detachment of dust receivers.
Figure 14B:
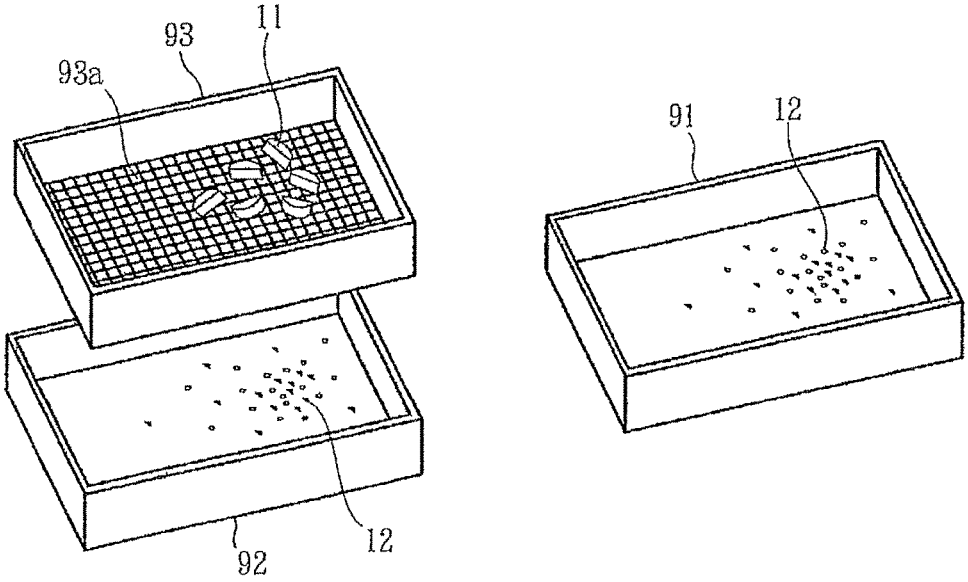

After the production of a predetermined number of split pieces 11, the first dust receiver 91 is withdrawn from the rear side of the body 24, the second dust receiver 92 is withdrawn from the front side of the body 24, and the split piece receiver 93 is upwardly detached from the second dust receiver 92 (refer to FIG. 14(*a*)). The split piece receiver 93 substantially contains only the split pieces 11, whereas most of the dust 12 is separated from the split pieces 11 and is accumulated in the first dust receiver 91 and the second dust receiver 92.

[Others]

In the embodiment, a sensor for detecting the tablets and split pieces 11 is not described; however, the sensor may be deployed in the passage of the split pieces 11 to detect the state of the falling split pieces 11. Preferably, the sensor is a contactless photosensor. As shown in FIG. 14(*a*), the sensor may be deployed at an appropriate position over which the tablet passes through, for example, at X1 in the tablet feeder base 27, X2 in the holding mechanism 30B, X3 adjacent to the tablet splitting position of the splitting mechanism 40B, X4 to receive the split pieces by the separating mechanism 80, or X5 to discharge the split pieces from the separating mechanism 80.

Although the switching member 81 rotating about the rotary shaft fitting in the bore 81*b* is described in the embodiment, the actual rotational state of the switching member 81 is not described. A supplementary explanation of the rotational state of the switching member 81 will now be given. The switching member 81 may continuously rotate about the rotary shaft at a constant rate. Alternatively, the switching member may remain at rest before the detection of the falling split piece 11 and may start to rotate upon the detection of the falling split piece 11. The falling split piece 11 is detected by, for example, the sensor deployed at the point X4 to receive the split piece 11 received by the separating mechanism 80. The detection of the falling split piece 11 may be confirmed by, for example, the output from the sensor. The rotation may be started at any timing; for example, the rotation may start with a predetermined time lag after the detection of the falling split pieces 11.

The predetermined time lag is preferably a period between the detection of the split pieces 11 falling from the holding mechanism 30B into the split piece path 81*a* and a static landing of the split piece 11 on the partitioning plate 82. With such a predetermined time lag, the dust 12 can be effectively separated. In specific, the basic operational advantage can be effectively achieved in that the dust 12 can be separated from the split pieces 11 moving in a tumbling and frictional state above the portioning plate 82 and can fall through the pores 82*a*. Additional operational advantages also can be effectively achieved in that the split pieces 11 moving above the partitioning plate 82 moves upstream against the inclined surface of the partitioning plate 82, so that the dust 12 adhering to the split pieces 11 can be effectively separated to fall on the portioning plate 82.

Although the switching member 81 according to the embodiment includes two split piece paths 81*a*, any number of the split piece path 81*a* may be provided, which may be more than two. For example, the switching member 81 may include four split piece paths 81*a*. In this case, the switching member 81 receives the split pieces 11 in first and second split piece paths 81*a* which are disposed above the portioning plate 82, and then causes a stepwise rotation by 180° about the rotary shaft. Such a configuration allows the switching member 81 to repeat the following operations in conjunction with the stepwise rotations; discharging the split pieces 11 from the first and second split piece paths 81*a* while receiving a third and fourth split pieces 11 in a third and fourth split piece paths 81*a*, and discharging the split pieces 11 from the third and fourth split piece paths 81*a* while receiving the split pieces 11 in the first and second split piece paths 81*a*.

Alternatively, the switching member 81 may include, for example, five split piece paths 81*a*. In this case, the switching member 81 receives the split pieces 11 in a first split piece path 81*a* disposed above the partitioning plate 82, and then causes a stepwise rotation by 144° about the rotary shaft. Such a configuration allows the switching member 81 to repeat the following operations in conjunction with the stepwise rotations; discharging the split pieces 11 from a first split piece path 81*a* while receiving the split pieces 11 in a third split piece path 81*a*, discharging the split pieces 11 from the third split piece path 81*a* while receiving the split pieces 11 in a fifth split piece path 81*a*, discharging the split pieces 11 from the fifth split piece path 81*a* while receiving the split pieces 11 in a second split piece path 81*a*, discharging the split pieces 11 from the second split piece path 81*a* while receiving the split pieces 11 in a fourth split piece path 81*a*, and then discharging the split pieces 11 from the fourth split piece 81*a* while receiving the split pieces 11 from the first split piece path 81*a*.

Although the tablet illustrated in the drawings relevant to the embodiments are split into two split pieces having equal dimensions, the tablet may be split into more than two pieces or into pieces having different dimensions.

Furthermore, the operating unit 22 provided in the tablet splitting apparatus 20B according to the embodiment is not essential; alternatively, any sequential operation may be started in response to the injection of the tablet. The tablet feeder base 27 and the tablet cassette 21 are also not essential if the automatic supply of the tablet is not required.

INDUSTRIAL APPLICABILITY

The tablet splitting apparatus according to the present invention can be stand-alone as in the embodiments described above. Alternatively, the tablet splitting apparatus can be incorporated into an automatic dispenser, such as a tablet packing apparatus (refer to the second embodiment of PTL 5, for example), so that the function is enhanced as a substitution of the base unit of the tablet feeder. The tablet splitting apparatus can also be incorporated into a tablet falling passage downwardly extending from a stand-alone tablet feeder, or into a tablet collecting passage residing below the tablet falling passage to allow the tablets passing through the tablet falling passage to meet each other (for example, refer to PTL 1 and 2).

REFERENCE SIGNS LIST

10 . . . tablet, 10*b*, 10*c*, 11 . . . split piece (tablet split piece), 12 . . . dust (of tablet split pieces), 20, 20A, 20B . . . tablet splitting apparatus, 21 . . . tablet cassette, 22 . . . operating unit, 23, 23A, 23B . . . controller, 24 . . . body (housing), 25 . . . receiver, 25*b* . . . left receiver, 25*c* . . . right receiver, 26 . . . transitive unit, 27 . . . tablet feeder base, 28 . . . support frame (support), 28A, 28B . . . support, 29 . . . projection (slidable unit), 30, 30A, 30B . . . holding mechanism, 31, 31A . . . guide plate (for falling tablet), 31U . . . depression (for slidable engagement), 32, 32A . . . tablet falling passage (guide passage), 32*a* . . . upstream path, 32*b* . . . left pathway, 32*c* . . . right pathway, 33 . . . splitting position (holding position), 34 . . . catcher, 34*b* . . . left arm (left-pathway opening/closing member), 34*c* . . . right arm (right-pathway opening/closing member), 35 . . . slit, 36 . . . fixed cover plate, 37, 37A . . . guide board (groove-depth defining member), 37*a* . . . tapered area, 37*b* . . . base area, 37*c* . . . projecting area, 37*d* . . . slit, 38 . . . thickness adjusting mechanism, 37*x*, 37*y* . . . biasing spring, 39 . . . sensor, 40, 40A, 40B . . . splitting mechanism, 41 . . . front blade (facing blade), 41*a* . . . blade edge, 41*b* . . . blade body, 41*c* . . . tapered portion, 41*d* . . . projection (for slidable engagement), 41*e* . . . depression (slidable unit), 42 . . . back blade (facing blade), 43 . . . front blade shifter, 44 . . . back blade shifter, 45 . . . servo motor, 46 . . . servo controller, 47 . . . driving current detector, 48 . . . position detector, 51 . . . lid, 52 . . . lock, 53 . . . hinge, 54 . . . opening, 60 . . . remover (for replacing blades), 61 . . . jig body, 62 . . . depression (slidable unit), 63 . . . notch, 64 . . . blade holder, 65 . . . fixer, 66 . . . projection (slidable unit), 67 . . . elastic wire, 68 . . . movable end (with strong hooking force), 70 . . . setter (jig for replacing blade), 71 . . . jig body, 72 . . . depression (slidable unit), 73 . . . notch, 74 . . . blade holder, 75 . . .

fixer, 76 . . . projection (slidable unit), 77 . . . elastic wire, 78 . . . movable end (with weak hooking force), 79 . . . utmost end, 80 . . . separating mechanism (mechanism for separating dust from tablet split piece or transitive unit incorporating the separating mechanism), 81 . . . switching member (for switching tablet falling paths), 81*a* . . . split piece path (split piece falling path), 81*b* . . . bore, 82 . . . partitioning plate, 82*a* . . . pore, 83 . . . supporting base (inclined support), 83*a* . . . dust path (dust falling path), 83*b* . . . bore, 84 . . . chute, 85 . . . rotational driving mechanism, 91 . . . first dust receiver (dilated portion of dust separating mechanism), 92 . . . second dust receiver (dilated portion of dust separating mechanism), 93 . . . split piece receiver, 93*a* . . . screen bottom (dilated portion of dust separating mechanism)

The invention claimed is:

1. A tablet splitting apparatus comprising:

a guide having a groove passage for guiding a falling tablet;

a catcher for holding a tablet moving downward through the groove passage at a mid-portion of the groove passage; and a splitting mechanism for splitting a tablet held by the catcher;

wherein the splitting mechanism comprises a pair of blades for splitting the tablet received by the catcher, and a pair of blade shifters that allow the blades to be attached thereto at predetermined positions, a housing is further provided in which the guide, the catcher, and the splitting mechanism are accommodated, the housing comprises an opening allowing the guide and the blades to move therethrough, and a support detachably fixing the guide at a supporting position in the housing, the support and the guide each comprise a sliding portion for fixing the guide, and the support and the guide are in a slidable contact with each other at the sliding portions while the guide is supported at the supporting position, the guide disposed at the supporting position is slid along the sliding portion of the support so as to be detachable from the supporting position through the opening, the blades and the blade shifters each comprise a sliding portion at which each of the blades is attached to a corresponding one of the blade shifters or at which each of the blade shifters allows a corresponding one of the blades to be attached thereto, and the blades and the blade shifters are in a slidable contact with each other at the sliding portions for attaching the blades while the blades are attached to the respective predetermined positions, and the blades attached to the respective predetermined positions of the blade shifters are slid along the sliding portions of the blade shifters so as to be detachable from the blade shifters through the opening.

2. The tablet splitting apparatus according to claim 1, wherein the sliding portion of the support for fixing the guide comprises an engaging structure which directs the guide in a predetermined sliding direction, the sliding portions of the blade shifters for attaching the blades each comprise an engaging structure which directs the corresponding blade in a predetermined sliding direction, and the sliding direction of the guide is parallel to the sliding directions of the blades.

3. The tablet splitting apparatus according to claim 2, wherein, after the detachment of the guide from the housing, the sliding portion of the support is slidably engageable with a sliding portion of a jig for replacing the blades, the jig for replacing the blades comprises a plate jig body having a sliding portion having a structure substantially identical to the structure of the sliding portion of the guide and a blade holder provided on the jig body, upon the sliding of the jig body engaging the support close to each blade shifter, the blade holder is capable of holding the corresponding blade attached to the blade shifter, and upon the sliding of the jig body away from the blade shifter while the blade is held by the blade holder, the blade held by the blade holder is detached from the blade shifter.

4. The tablet splitting apparatus according to claim 2, wherein, after the detachment of the guide from the housing, the sliding portion of the support is slidably engageable with a sliding portion of a jig for replacing the blades, the jig for replacing the blades comprises a plate jig body having a sliding portion having a structure substantially identical to the structure of the sliding portion of the guide, and a blade holder provided on the jig body, the blade holder holds each blade to be attached in a detachable state, and upon the sliding of the jig body carrying the blade held by the blade holder close to the corresponding blade shifter, the blade held by the blade holder is engageable with the blade shifter so as to be attached to the blade shifter, and upon the sliding of the jig body away from the blade shifter, the blade holder is detachable from the blade held by the blade shifter to the exterior of the housing.

5. The tablet splitting apparatus according to claim 1, further comprising:

a groove-depth defining member disposed upstream of the catcher in a tablet moving direction, wherein a guide passage is defined by said groove passage and a surface of said groove-depth defining member facing the groove passage;

a sensor for detecting a tablet passing through an upstream portion of the guide passage;

a thickness adjusting mechanism for varying a distance between the facing surface of the groove-depth defining member and the groove passage; and a controller configured to control the operation of the thickness adjusting mechanism, wherein the distance between the facing surface of the groove-depth defining member and the groove passage is controllable at least between a narrow state preventing a tablet from passing the facing surface and a wide state allowing a tablet to pass the facing surface, and the controller is further configured to perform a thickness measuring operation which activates the thickness adjusting mechanism to expand said distance in the narrow state in the presence of a tablet residing upstream of the facing surface, and to halt the thickness adjusting mechanism to fix said distance based on the detection of a tablet passing the facing surface.

6. The tablet splitting apparatus according to claim 5, wherein the catcher is switchable between a holding state which holds a tablet in a mid-portion of the guide passage and a releasing state which releases a held tablet, the pair of blades comprises facing electric blades movable under the control of the controller, the tablet splitting apparatus further comprises a detector configured to detect driving current driving the facing blades, wherein the facing blades are each movable at least between a retracted position allowing a tablet to be injected into an interspace between edges of the facing blades, a catching position allowing the edges of the facing blades to catch an injected tablet, and a split completion position allowing a caught tablet to be split, wherein the controller is configured to perform an advancing operation which directs the facing blades to the split completion position after a tablet is injected into the interspace between the facing blades and is held by the catcher, and a catch detection operation which detects the facing blades reaching the catching positions based on an increase in the driving current in the middle of the advancing operation, and the controller further performs at least one of a speed changing operation which changes a speed of the facing blades moving from the catching position to the split completion position to split a tablet based on the catch detection operation, relative to a speed of the facing blades moving toward the catching position, and a releasing operation which switches the holding state of the catcher to the releasing state to release a tablet held by the catcher.

7. The tablet splitting apparatus according to claim 1, further comprising:

a switching member having tablet falling paths allowing split pieces produced by the split of the tablet to pass therethrough;

a partitioning plate having a number of pores allowing dust generated by the split of the tablet to pass therethrough; and a supporting base having a dust falling path allowing the dust to pass therethrough, wherein a top end surface of the dust falling path is covered by the partitioning plate, the switching member is supported so as to be rotatable between positions which allow one of the tablet falling paths to be positioned above the partitioning plate, the switching member comprises a rotary shaft perpendicular to the partitioning plate or an extension of the partitioning plate, and the one of the tablet falling paths disposed above the partitioning plate has a bottom end surface covered by the partitioning plate, while the other of the tablet falling paths has a bottom end surface open in a releasing position.

8. The tablet splitting apparatus according to claim 7, wherein the rotary shaft of the switching member and the partitioning plate are inclined, and the one of the tablet falling paths disposed above the partitioning plate resides at a position lower than that of the other of the tablet falling paths.

9. The tablet splitting apparatus according to claim 7, further comprising:

a first dust receiver disposed below the dust falling path, a split piece receiver disposed at a position to receive the split pieces falling through the other of the tablet falling paths which is moved from the position above the partitioning plate to the releasing position, and a second dust receiver disposed below the split piece receiver, wherein the first dust receiver accommodates the dust falling through the dust falling path, the split piece receiver has a bottom allowing the dust to pass therethrough, and the second dust receiver accommodates the dust falling through the bottom.

10. The tablet splitting apparatus according to claim 2, further comprising:

a groove-depth defining member disposed upstream of the catcher in a tablet moving direction, wherein a guide passage is defined by said groove passage and a surface of said groove-depth defining member facing the groove passage;

a sensor for detecting a tablet passing through an upstream portion of the guide passage;

a thickness adjusting mechanism for varying a distance between the facing surface of the groove-depth defining member and the groove passage; and a controller configured to control the operation of the thickness adjusting mechanism, wherein the distance between the facing surface of the groove-depth defining member and the groove passage is controllable at least between a narrow state preventing a tablet from passing the facing surface and a wide state allowing a tablet to pass the facing surface, and the controller is further configured to perform a thickness measuring operation which activates the thickness adjusting mechanism to expand said distance in the narrow state in the presence of a tablet residing upstream of the facing surface, and to halt the thickness adjusting mechanism to fix said distance based on the detection of a tablet passing the facing surface.

11. The tablet splitting apparatus according to claim 3, further comprising:

a groove-depth defining member disposed upstream of the catcher in a tablet moving direction, wherein a guide passage is defined by said groove passage and a surface of said groove-depth defining member facing the groove passage;

a sensor for detecting a tablet passing through an upstream portion of the guide passage;

a thickness adjusting mechanism for varying a distance between the facing surface of the groove-depth defining member and the groove passage; and a controller configured to control the operation of the thickness adjusting mechanism, wherein the distance between the facing surface of the groove-depth defining member and the groove passage is controllable at least between a narrow state preventing a tablet from passing the facing surface and a wide state allowing a tablet to pass the facing surface, and the controller is further configured to perform a thickness measuring operation which activates the thickness adjusting mechanism to expand said distance in the narrow state in the presence of a tablet residing upstream of the facing surface, and to halt the thickness adjusting mechanism to fix said distance based on the detection of a tablet passing the facing surface.

12. The tablet splitting apparatus according to claim 4, further comprising:

a groove-depth defining member disposed upstream of the catcher in a tablet moving direction, wherein a guide passage is defined by said groove passage and a surface of said groove-depth defining member facing the groove passage;

a sensor for detecting a tablet passing through an upstream portion of the guide passage;

a thickness adjusting mechanism for varying a distance between the facing surface of the groove-depth defining member and the groove passage; and a controller configured to control the operation of the thickness adjusting mechanism, wherein the distance between the facing surface of the groove-depth defining member and the groove passage is controllable at least between a narrow state preventing a tablet from passing the facing surface and a wide state allowing a tablet to pass the facing surface, and the controller is further configured to perform a thickness measuring operation which activates the thickness adjusting mechanism to expand said distance in the narrow state in the presence of a tablet residing upstream of the facing surface, and to halt the thickness adjusting mechanism to fix said distance based on the detection of a tablet passing the facing surface.

13. The tablet splitting apparatus according to claim 2, further comprising:

a switching member having tablet falling paths allowing split pieces produced by the split of the tablet to pass therethrough;

a partitioning plate having a number of pores allowing dust generated by the split of the tablet to pass therethrough; and a supporting base having a dust falling path allowing the dust to pass therethrough, wherein a top end surface of the dust falling path is covered by the partitioning plate, the switching member is supported so as to be rotatable between positions which allow one of the tablet falling paths to be positioned above the partitioning plate, the switching member comprises a rotary shaft perpendicular to the partitioning plate or an extension of the partitioning plate, and the one of the tablet falling paths disposed above the partitioning plate has a bottom end surface covered by the partitioning plate, while the other of the tablet falling paths has a bottom end surface open in a releasing position.

14. The tablet splitting apparatus according to claim 3, further comprising:

a switching member having tablet falling paths allowing split pieces produced by the split of the tablet to pass therethrough;

a partitioning plate having a number of pores allowing dust generated by the split of the tablet to pass therethrough; and a supporting base having a dust falling path allowing the dust to pass therethrough, wherein a top end surface of the dust falling path is covered by the partitioning plate, the switching member is supported so as to be rotatable between positions which allow one of the tablet falling paths to be positioned above the partitioning plate, the switching member comprises a rotary shaft perpendicular to the partitioning plate or an extension of the partitioning plate, and the one of the tablet falling paths disposed above the partitioning plate has a bottom end surface covered by the partitioning plate, while the other of the tablet falling paths has a bottom end surface open in a releasing position.

15. The tablet splitting apparatus according to claim 4, further comprising:

a switching member having tablet falling paths allowing split pieces produced by the split of the tablet to pass therethrough;

a partitioning plate having a number of pores allowing dust generated by the split of the tablet to pass therethrough; and a supporting base having a dust falling path allowing the dust to pass therethrough, wherein a top end surface of the dust falling path is covered by the partitioning plate, the switching member is supported so as to be rotatable between positions which allow one of the tablet falling paths to be positioned above the partitioning plate, the switching member comprises a rotary shaft perpendicular to the partitioning plate or an extension of the partitioning plate, and the one of the tablet falling paths disposed above the partitioning plate has a bottom end surface covered by the partitioning plate, while the other of the tablet falling paths has a bottom end surface open in a releasing position.

16. The tablet splitting apparatus according to claim 5, further comprising:

a switching member having tablet falling paths allowing split pieces produced by the split of the tablet to pass therethrough;

a partitioning plate having a number of pores allowing dust generated by the split of the tablet to pass therethrough; and a supporting base having a dust falling path allowing the dust to pass therethrough, wherein a top end surface of the dust falling path is covered by the partitioning plate, the switching member is supported so as to be rotatable between positions which allow one of the tablet falling paths to be positioned above the partitioning plate, the switching member comprises a rotary shaft perpendicular to the partitioning plate or an extension of the partitioning plate, and the one of the tablet falling paths disposed above the partitioning plate has a bottom end surface covered by the partitioning plate, while the other of the tablet falling paths has a bottom end surface open in a releasing position.

17. The tablet splitting apparatus according to claim 6, further comprising:

a switching member having tablet falling paths allowing split pieces produced by the split of the tablet to pass therethrough;

a partitioning plate having a number of pores allowing dust generated by the split of the tablet to pass therethrough; and a supporting base having a dust falling path allowing the dust to pass therethrough, wherein a top end surface of the dust falling path is covered by the partitioning plate, the switching member is supported so as to be rotatable between positions which allow one of the tablet falling paths to be positioned above the partitioning plate, the switching member comprises a rotary shaft perpendicular to the partitioning plate or an extension of the partitioning plate, and the one of the tablet falling paths disposed above the partitioning plate has a bottom end surface covered by the partitioning plate, while the other of the tablet falling paths has a bottom end surface open in a releasing position.

18. The tablet splitting apparatus according to claim 8, further comprising:

a first dust receiver disposed below the dust falling path, a split piece receiver disposed at a position to receive the split pieces falling through the other of the tablet falling paths which is moved from the position above the partitioning plate to the releasing position, and a second dust receiver disposed below the split piece receiver, wherein the first dust receiver accommodates the dust falling through the dust falling path, the split piece receiver has a bottom allowing the dust to pass therethrough, and the second dust receiver accommodates the dust falling through the bottom.

* * * * *